US006896357B2

(12) United States Patent
Murakami et al.

(10) Patent No.: US 6,896,357 B2
(45) Date of Patent: May 24, 2005

(54) INK-JET PRINTING HEAD AND INK-JET PRINTING APPARATUS AND METHOD

(75) Inventors: Shuichi Murakami, Kanagawa (JP); Michinari Mizutani, Kanagawa (JP); Takashi Inoue, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/176,056

(22) Filed: Jun. 21, 2002

(65) Prior Publication Data

US 2002/0196309 A1 Dec. 26, 2002

(30) Foreign Application Priority Data

Jun. 21, 2001 (JP) ..... 2001-188516
Aug. 10, 2001 (JP) ..... 2001-243318
Jun. 17, 2002 (JP) ..... 2002-176342

(51) Int. Cl.[7] ..... B41J 2/21
(52) U.S. Cl. ..... 347/43; 347/40
(58) Field of Search ..... 347/12, 40, 15, 347/43, 16, 41

(56) References Cited

U.S. PATENT DOCUMENTS 5,208,605 A * 5/1993 Drake ..... 347/15
6,137,502 A 10/2000 Anderson et al. ..... 347/15
6,471,322 B2 * 10/2002 Kanda et al. ..... 347/15

OTHER PUBLICATIONS

Patent Abstracts of Japan, vol. 009, No. 051 (M–361), Mar. 6, 1985 (JP 59 187861, Oct. 25, 1984).

* cited by examiner

*Primary Examiner*—Lamson D Nguyen
(74) *Attorney, Agent, or Firm*—Fitzpatrick, Cella, Harper & Scinto

(57) ABSTRACT

The present invention provides an ink-jet printing head, and an ink-jet printing apparatus and method which enable high-gradation and high-quality images to be printed using dots of different sizes. In an ink-jet printing head according to the present invention, at least one second nozzle has its center arranged on an imaginary line extending in a main-scanning direction of the printing head through the center of a first nozzle. The volume of an ink droplet ejected through the second nozzle is smaller than that of an ink droplet ejected through the first nozzle. Further, the number of second nozzles is larger than that of first nozzles.

9 Claims, 25 Drawing Sheets

INK-JET PRINTING HEAD AND INK-JET PRINTING APPARATUS AND METHOD

This application is based on Japanese Patent Application Nos. 2001-188516 filed Jun. 21, 2001, 2001-243318 filed Aug. 10, 2001, and 2002-176342 filed Jun. 17, 2002, the contents of which are incorporated hereinto by reference.

BACKGROUND OF THE INVENTION

1. Field of the Invention

The present invention relates to an ink-jet printing head and an ink-jet printing apparatus and method.

2. Description of the Related Art

Ink-jet printing apparatuses, which eject ink droplets from an ink-jet printing head to print an image, can print an image with various gradations by varying the size of the droplets.

A conventional ink-jet printing head, for example, the one described in U.S. Pat. No. 5,208,605, has two nozzle lines formed therein parallel with each other and extending in a direction crossing a scanning direction. One of the nozzle lines has a plurality of larger nozzles (larger ejection openings) arranged at equal intervals and through which large ink-droplets are ejected. In contrast, the other nozzle line has a plurality of smaller nozzles (smaller ejection openings) arranged at equal intervals and through which small ink-droplets are ejected. The larger and smaller nozzles are communication with a common ink supply port, and the same type of ink is ejected through these nozzles.

A printing head constructed in this manner ejects ink droplets through the larger and smaller nozzles while moving in the scanning direction, to form large and small ink dots on a printing medium.

Applicant of the present invention examined a printed image printed by using the conventional printing head. The printed image is obtained by high-density pixels and low-density pixels, high-density pixels corresponding to the large ink dots are formed by large ink-droplets ejected from the larger nozzles, and low-density pixels corresponding to the small ink dots are ejected from the smaller nozzles. Result of the examination, unwanted stripes and noticeable granularity are appeared in printed images, thereby making it difficult to print photograph-grade images.

Applicant of the present invention found out one of the causes of the phenomenon. It is caused by the arrangement in which the positions of the larger nozzles deviate from the position of the smaller nozzles in the direction of the nozzle lines. That is, in the conventional printing head, the position of large dots formed by large ink-dots ejected from the larger nozzles deviate from the position of small dots formed by small ink-dots ejected from the smaller nozzles, because the positions of the larger nozzles deviate from the position of the smaller nozzles in the direction of the nozzle lines. Therefore, if the large dot is formed on a center of a pixel, the position of the small dot deviate from a center of a low-density pixel formed by one small dot. Thus, in a low-density pixel in which a small dot is formed, a large and unwanted stripe shape blank is created within the pixel, the blank amounting to the deviation of the position of the small dot from the center.

Further, when printing an image is performed by using the conventional printing head, as shown in FIG. 20, the junction part between large dots D1 coincides with the junction part between small dots D3 on a line L extending along the scanning direction of the printing head. Accordingly, when the ejecting directions of the large ink-droplets and small ink-droplets are deviated each other, gap caused at the position corresponding to the junction part between large dots D1 links with gap caused at the position corresponding to the junction part between small dots D3. The linking gaps are appeared in the printed images, as the unwanted stripes.

Furthermore, as sown in FIG. 21, if the small dots D3 will be formed at the portion adjoined large dots D1, it is difficult to form the small dots D3 independently without overlapping with the large dots D1. The large dots D1 and the small dots D3 are into dots D0 larger than large dots D1. Therefore, noticeable granularity is appeared in printed images due to the dots D0.

SUMMARY OF THE INVENTION

It is an object of the present invention to provide an ink-jet printing head, and ink-jet printing apparatus and method which enable high-gradation and high-quality images to be printed using dots of different sizes.

In a first aspect of the present invention, there is provided an ink-jet printing head having a plurality of nozzles through which the printing head ejects ink droplets of the same color while moving in a scanning direction, wherein the nozzles include a plurality of first nozzles through which a predetermined volume of ink droplets are ejected and a plurality of second nozzles through which a predetermined volume of ink droplets less than that of ink droplets ejected through the first nozzles are ejected, the number of the plurality of second nozzles is larger than the number of the plurality of first nozzles, and at least one of the second nozzles has a center thereof located on a first imaginary line extending in the scanning direction through a center of each of the first nozzles.

In a second aspect of the present invention, there is provided an ink-jet printing method for printing on a printing medium using an ink-jet printing head of the present invention, wherein dots of different sizes are formed on the printing medium by ink droplets ejected through the first and second nozzles.

In a third aspect of the present invention, there is provided an ink-jet printing method for printing on a printing medium using an ink-jet printing head of the present invention, wherein printing is carried out by alternately arranging, relative to the scanning direction, at least one large dot formed on the printing medium using an ink droplet ejected through at least one of the first nozzles and a plurality of small dots formed on the printed medium using a plurality of ink droplets ejected through the second nozzles.

In a fourth aspect of the present invention, there is provided an ink-jet printing apparatus for printing on a printing medium using an ink-jet printing head of the present invention, comprising:

movement means for moving the ink-jet printing head and the printing medium relatively to each other, wherein dots of different sizes are formed on the printing medium using ink droplets ejected through the first and second nozzles.

According to a printing head of the present invention, on an imaginary line extending in a main-scanning direction of the printing head through the center of a first nozzle (larger-diameter nozzle; larger-diameter ejection opening), the center of at least one second nozzle (smaller-diameter nozzle; smaller-diameter ejection opening) is arranged. Accordingly, when one dot is formed within a print range on a printing medium, a blank within the print range is uniformly distributed to the exterior of the periphery of the small dot and is not noticeable. Further, when printing is performed by forming the large and small dots, the junction parts between the large dots and between the small dots can be arranged to deviate from each other so as not to lie on the same line along the scanning direction of the printing head. This hinders unwanted strips from appearing in printed images, thereby enabling high-gradation and high-quality images to be printed.

Further, the number of second nozzles (smaller-diameter nozzles; smaller-diameter ejection openings) is larger than that of first nozzles (larger-diameter nozzles; larger-diameter ejection openings). Accordingly, high-definition images can be printed using more small dots. Furthermore, the use frequency of the second nozzles can be distributed to improve their durability.

Moreover, the manner is set in which the first nozzles (larger-diameter nozzles; larger-diameter ejection openings) and the second nozzles (smaller-diameter nozzles; smaller-diameter ejection openings) are arranged. Then, a driving frequency used to eject ink droplets through these nozzles is set at a fixed value in association with the scanning speed of the printing head, thereby allowing images to be printed at high speed. Further, depending on the manner in which the first nozzles (larger-diameter nozzles; larger-diameter ejection openings) and the second nozzles (smaller-diameter nozzles; smaller-diameter ejection openings) are arranged, large and small dots formed using these nozzles can be arbitrarily combined together to print high-quality images.

The above and other objects, effects, features and advantages of the present invention will become more apparent from the following description of embodiments thereof taken in conjunction with the accompanying drawings.

DETAILED DESCRIPTION OF PREFERRED EMBODIMENTS

First, basic configurations of a printing head and a printing apparatus to which the present invention is applicable will be described with reference to FIGS. 1 to 4.

(Basic Configuration)

Figure 1:
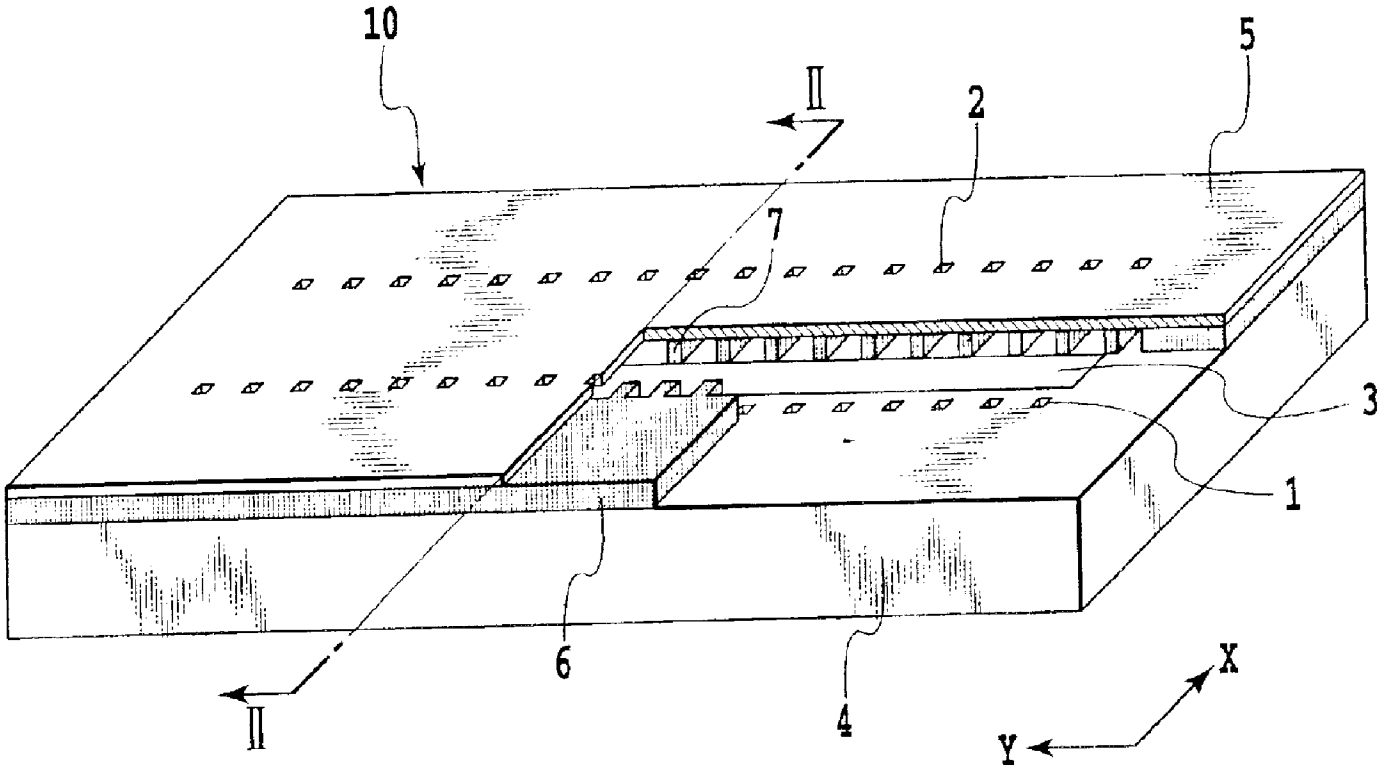
FIG. 1 is a partially cutaway perspective view of a printing head to which the present invention is applicable.
Figure 2:
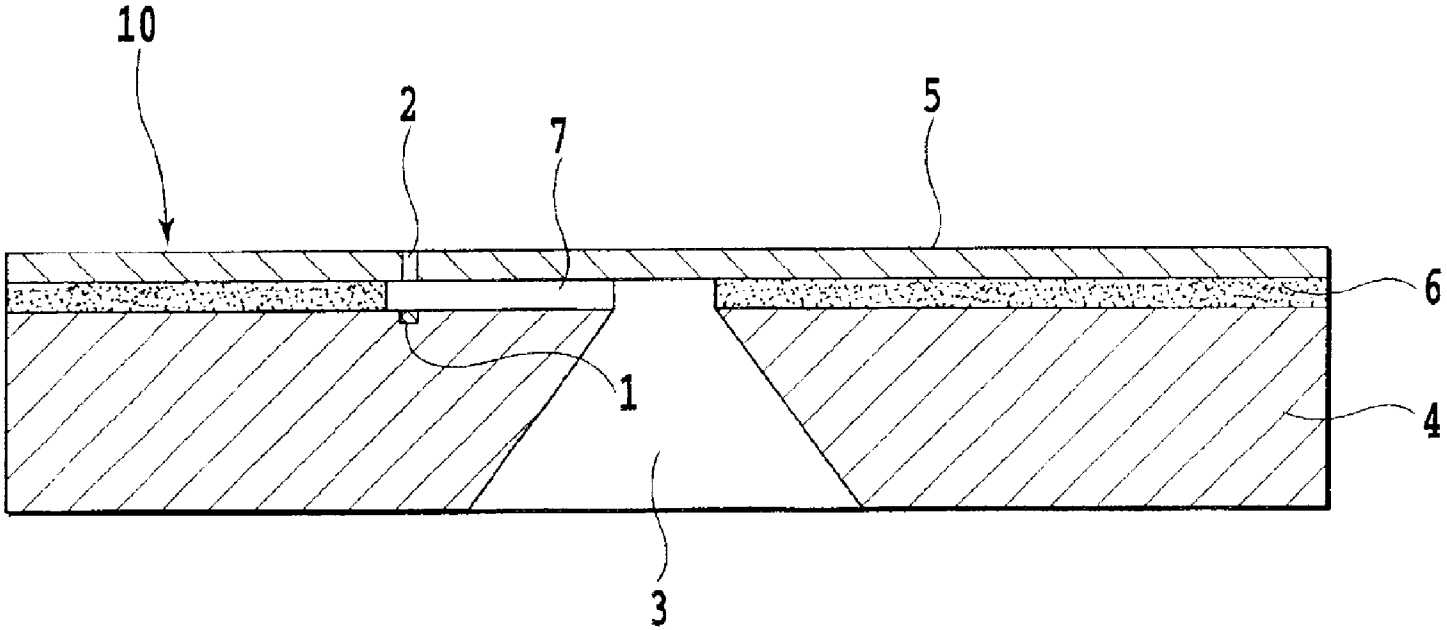
FIG. 2 is an enlarged sectional view taken along line II—II in FIG. 1.

FIG. 1 is a partially cutaway perspective view of a printing head to which the present invention is applicable. FIG. 2 is a sectional view taken along line II—II in FIG. 1.

A printing head 10 in this example comprises a substrate 4 composed of glass, ceramics, plastic, metal, or the like. Material for the substrate 4 is arbitrary and has only to function as part of an ink channel constituting member and as a support for material layers forming thermal energy generating means, ink channels, and ink nozzles, described later. In this example, the substrate 4 is a Si substrate (wafer). The substrate 4 comprises electrothermal conversion elements 3 as thermal energy generating means, and an ink supply port 3. The electrothermal conversion elements 1 are arranged at each side of the ink supply port 3 composed of a through-slot. In FIGS. 1 and 2, electric wires and the like which are used to drive the electrothermal conversion elements 1 are not shown. The substrate 4 is provided with ink channel walls 7 that define ink channels. A nozzle plate 5 having nozzles 2 is provided on the ink channel walls 7. The ink channel walls 7 in this example are each formed of a coating resin layer 6 different from the member constituting the nozzle plate 5. However, by forming the ink channel walls 7 on the substrate 4 using a process such as spin coating, the ink channel walls 7 and the nozzle plate 5 can be simultaneously formed using the same member.

Ink for image formation is supplied through the ink supply port 3 and introduced into the ink channels formed by the ink channel walls 7. Then, electricity is conducted through the electrothermal conversion elements 1 via wires (not shown) to cause the electrothermal conversion elements 1 to generate thermal energy. Then, ink in the ink channels 7 is heated to generate bubbles because of film boiling. The resulting bubbling energy causes ink droplets to be ejected through the nozzles 2. The nozzles 2 are densely arranged to constitute a printing head 10 based on a multinozzle ink-jet method. In this example, the electrothermal conversion element 1 and the nozzle 2 are disposed opposite each other for each of the large number of ink channels formed by the ink channel walls 7.

Figure 3:
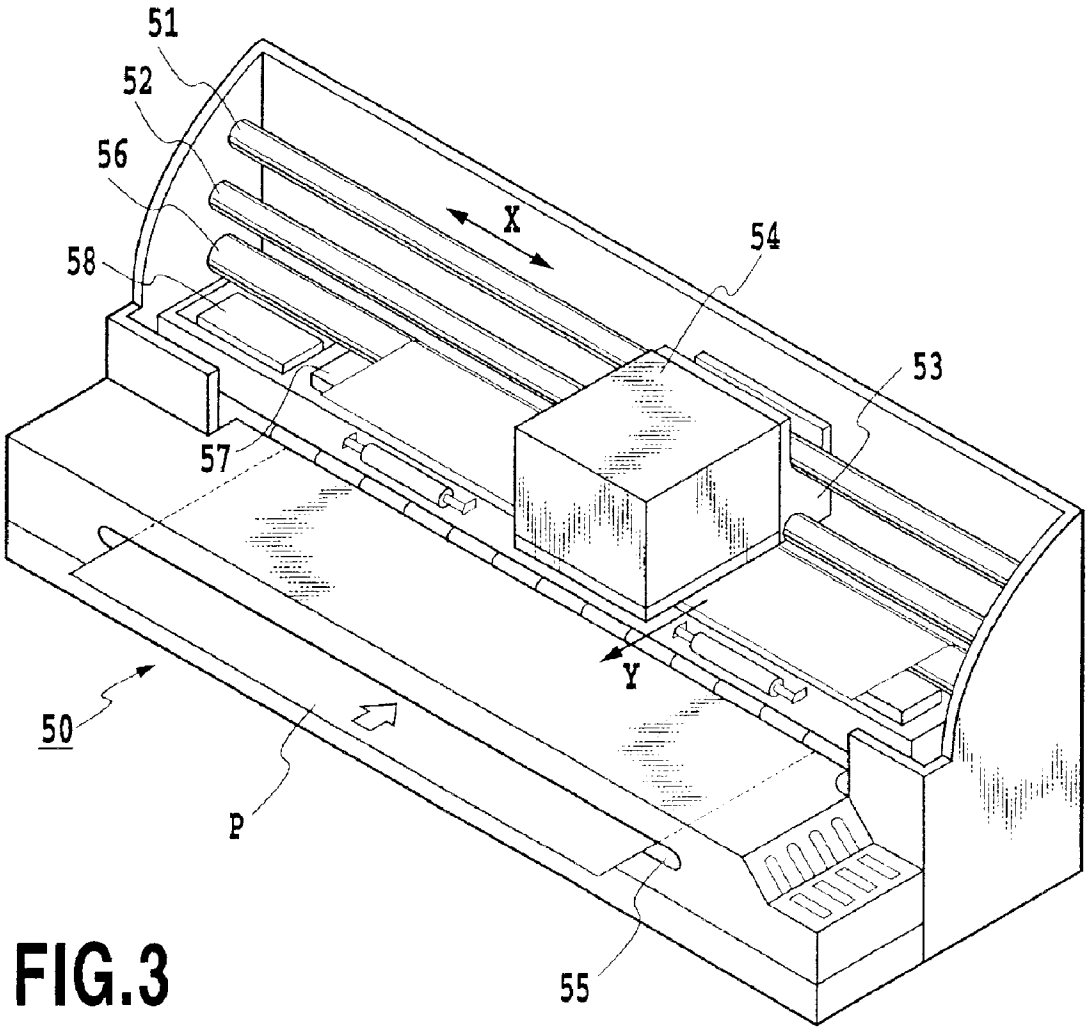
FIG. 3 is a schematic perspective view of a printing apparatus to which the present invention is applicable.

FIG. 3 is a perspective view schematically illustrating the configuration of a printing apparatus to which the present invention is applicable.

A printing apparatus 50 in this example is based on a serial scan method. Guide shafts 51 and 52 guide a carriage 53 so that the carriage 53 can be moved in a main-scanning direction, shown by arrow X. The carriage 53 is reciprocated in the main scanning direction using a carriage motor and driving force transmitting mechanisms such as belts which transmit driving force from the motor. The carriage 53 has the printing head 10 (not shown in FIG. 2) mounted thereon and ink tanks 54 also mounted thereon and from which ink is supplied to the printing head 10. The printing head 10 and the ink tanks 54 may constitute an ink-jet cartridge. A sheet P as a printing medium is inserted through an insertion port 55 formed at a front end of the apparatus, subsequently has its transportation direction reversed, and is then transported by a feed roller 56 in a sub-scanning direction shown by arrow Y. The printing apparatus 50 sequentially prints an image on the sheet P by repeating a printing operation and a transportation operation. In the printing operation, ink is ejected to a print area of the sheet P on a platen 5 while moving the printing head 10 in the main-scanning direction. In the transportation operation, the sheet P is transported in the sub-scanning direction a distance corresponding to the print width of the sheet P.

In FIG. 3, a recovery unit (recovery process means) 58 is located at the left end in a moving area of the carriage 53. The recovery unit is opposite to a surface, in which the nozzles 2 are formed, of the printing head 10 mounted on the carriage 53. The recovery unit 58 comprises a cap that can cap the nozzles 2 of the printing head 10, a suction pump that can introduce negative pressure into the cap, and others. The recovery unit 58 executes a recovery process (also referred to as a "suction recovery process") for introducing negative pressure into the cap, covering the nozzles 2, to suck and discharge ink through the nozzles 2 in order to maintain the appropriate ink ejection state of the printing head 10. Alternatively, in order to maintain the appropriate ink ejection state of the printing head 10, the recovery process (also referred to as the "ejection recovery process") may be executed by ejecting ink that does not contribute to image formation, through the nozzles 2 toward the cap.

Figure 4:
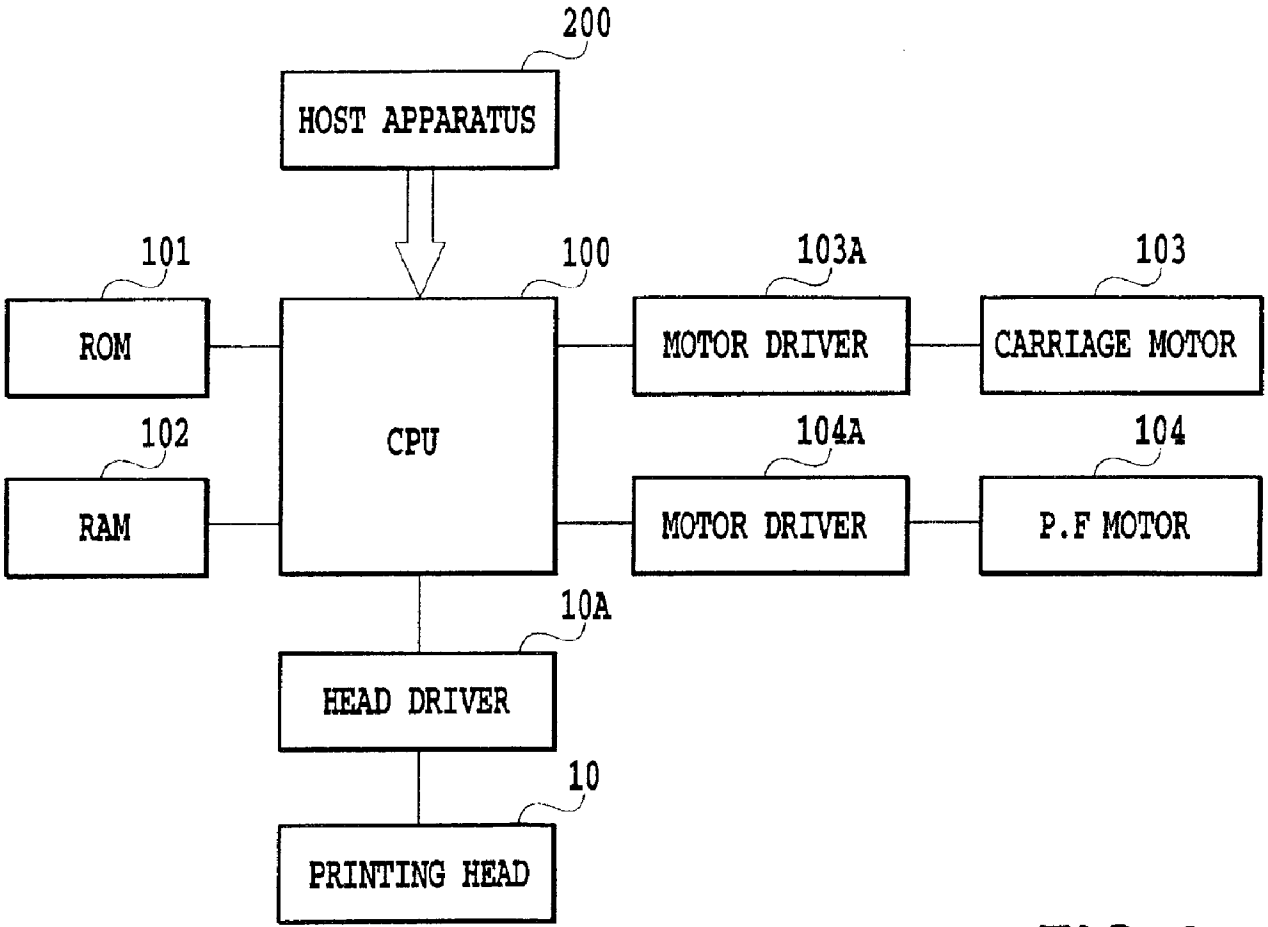
FIG. 4 is a block diagram of a control system of the printing apparatus in FIG. 3.

FIG. 4 is a schematic block diagram of a control system of a printing apparatus to which the present invention is applicable.

In FIG. 4, a CPU 100 executes processes of controlling operations of the present printing apparatus, data processing, and others. A ROM 101 stores programs for these process procedures and others, and a RAM 102 is used as a work area or the like to execute these processes. A head driver 10A is supplied driving data (image data) for the electrothermal conversion elements 1 and driving control signals (heat pulse signals) by the CPU 100, thereby, ink is ejected from the printing head 10. The CPU 100 controls, via a motor driver 103A, a carriage motor 103 for driving the carriage 53 in the main-scanning direction, and controls, via a motor driver 104A, a P.F motor 104 for transporting the sheet P in the sub-scanning direction.

(First Embodiment)

Figure 5:
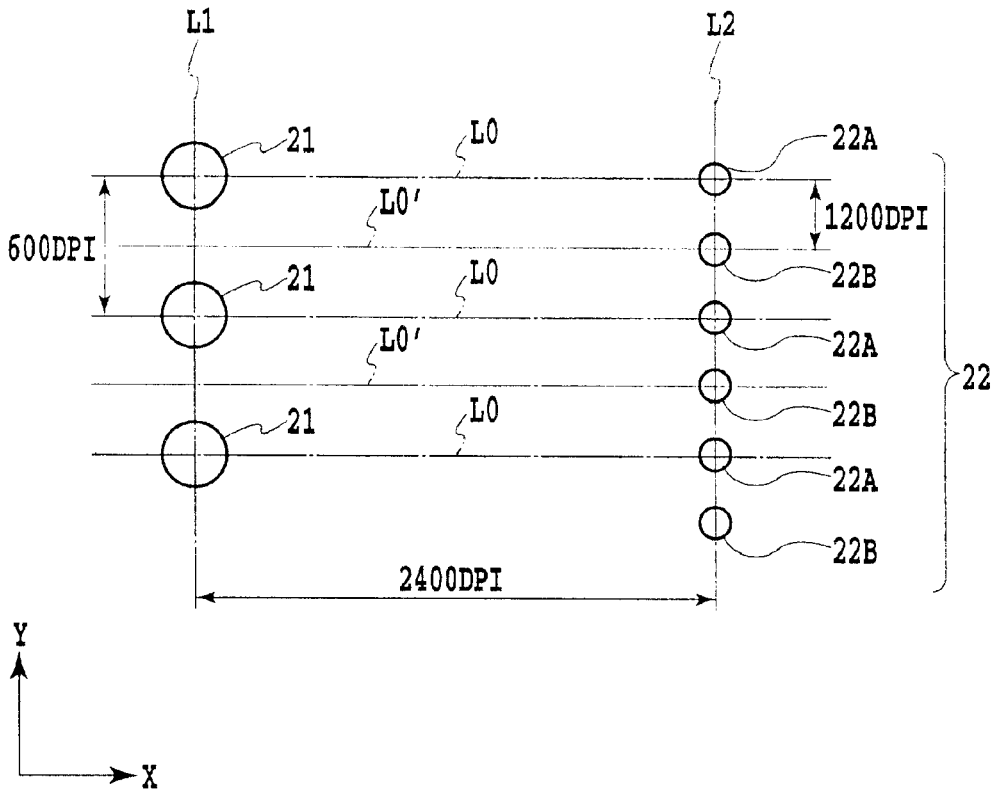
FIG. 5 is a diagram illustrating how nozzles are arranged in a printing head according to a first embodiment of the present invention.

FIG. 5 is a plan view of an essential part of a printing head according to a first embodiment of the present invention.

In this example, as shown in FIG. 5, a printing head 10 has a plurality of nozzles (ejection openings) formed on lines L1 and L2 arranged along the main-scanning direction shown by an arrow X. Ink droplets of the same color are ejected from the plurality of nozzles. The line L1 has larger-diameter nozzles (larger-diameter ejection openings) 21 formed thereon at equal intervals. The distance between the larger-diameter nozzles 21 corresponds to a resolution of 600 DPI (Dot Per Inch). The line L2 has smaller-diameter nozzles (smaller-diameter ejection openings) 22 formed thereon at equal intervals. The distance between the smaller-diameter nozzles 22 corresponds to a resolution of 1200 DPI. The center of the larger-diameter nozzle 21 on the line L1 and the center of a smaller-diameter nozzle 22A on the line L2 are located on an imaginary centerline L0 extending along the main-scanning direction, shown by the arrow X. Further, on the line L2, a smaller-diameter nozzle 22B is located midway between the adjacent smaller-diameter nozzles 22A. In this example, the larger-diameter nozzle line L1 deviates 10.7 μm from the smaller-diameter nozzle line L2. The printing head 10 performs a printing operation while being moved in the direction of the arrow X (main-scanning direction) at a speed of 10 inch/sec.

The printing head 10 has ink channels defined by ink channel walls 7 and corresponding to the larger-diameter nozzles 21 and smaller-diameter nozzles 22. Each of the ink channels is provided with an electrothermal conversion element 1 located opposite the corresponding larger-diameter nozzle 21 or smaller-diameter nozzle 22. In this example, the amount of ink ejected through the larger-diameter nozzle 21 is 10 pl (pico liter). The larger-diameter nozzle 21 has a diameter of 23 μm. The electrothermal conversion element 1 located opposite the larger-diameter nozzle 21 has a size of 30×30 μm. On the other hand, the amount of ink ejected through the smaller-diameter nozzle 22 is 2 pl. The smaller-diameter nozzle 22 has a diameter of 11 μm. Further, channel height is 14 μm, and nozzle plate thickness is 11 μm.

Figure 6:
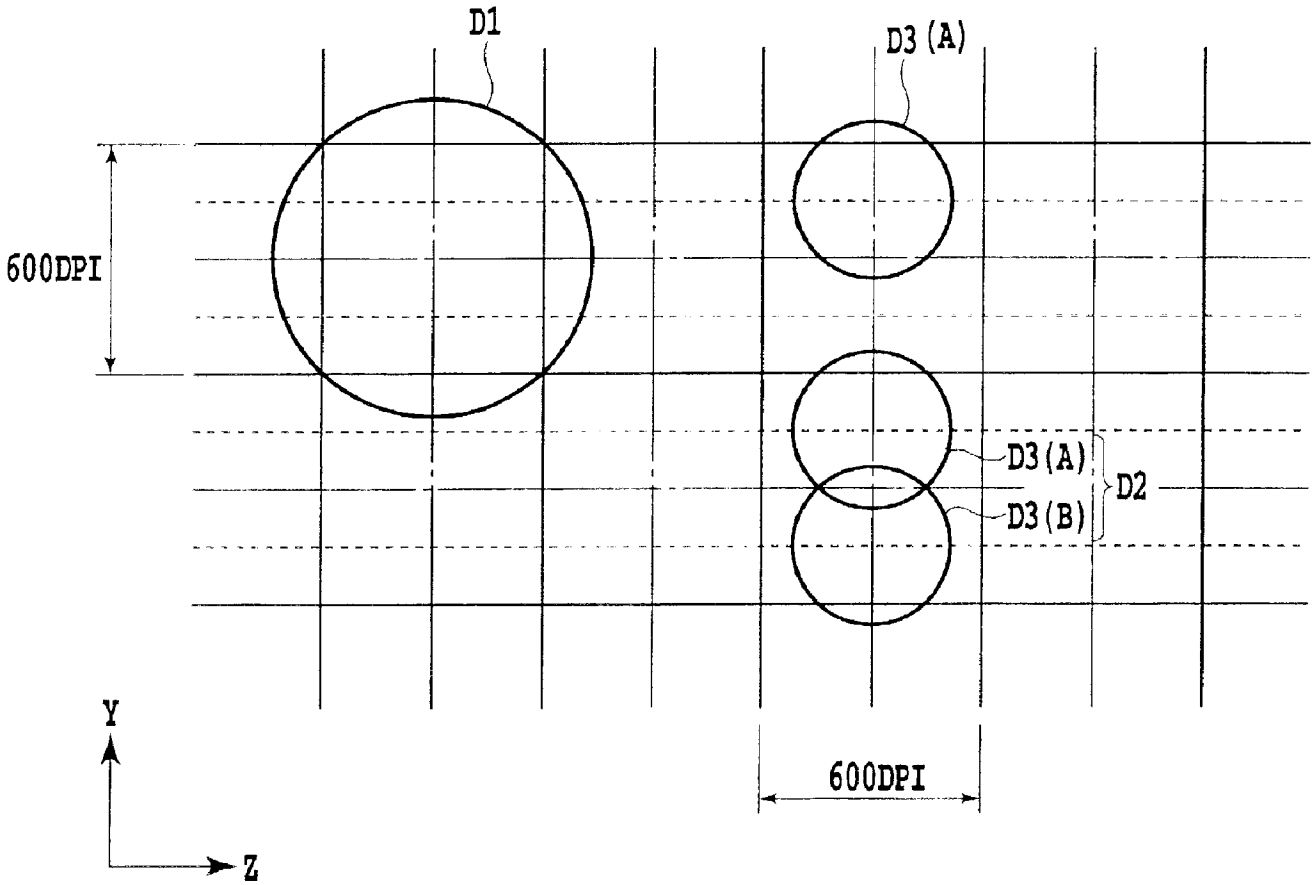
FIG. 6 is a diagram illustrating dots formed using the printing head shown in FIG. 5.

FIG. 6 is a diagram illustrating the arrangement of ink dots formed on a sheet P as a printing medium using the printing head 10.

An ink droplet ejected through the larger-diameter nozzle 21 forms a large dot D1 in a unit print range 600×600 DPI on the sheet P. Further, an ink droplet ejected through the smaller-diameter nozzle 22 forms a small dot D3. In FIG. 6, a small dot D3(A) is formed by an ink droplet ejected through the smaller-diameter nozzle 22A. Further, a small dot D3(B) is formed by an ink droplet ejected through the smaller-diameter nozzle 22B. Furthermore, the ink droplets ejected through the two smaller-diameter nozzles 22A and 22B form a middle-sized dot D2. That is, as shown in FIG. 6, the two small dots D3(A) and D3(B) are overlapped and deviated each other to form the middle-sized dot D2.

Figure 7:
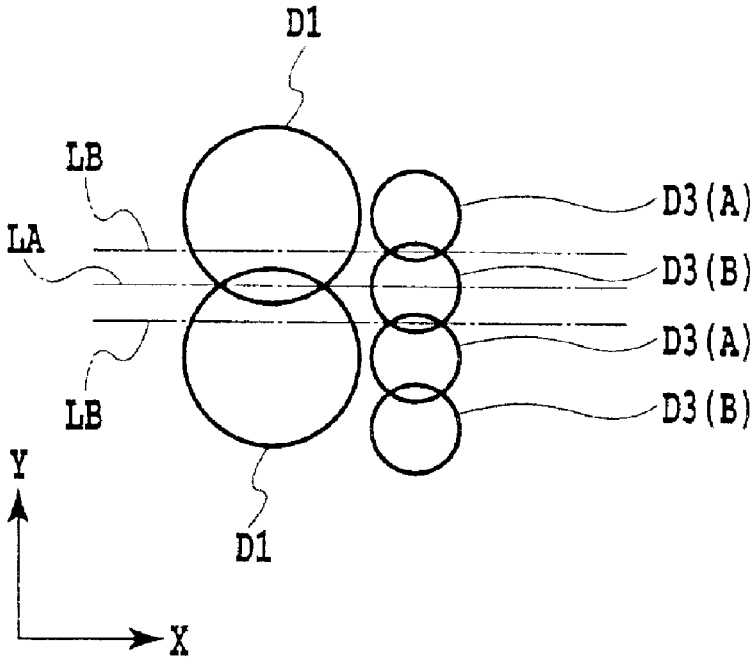
FIG. 7 is a diagram illustrating the junction part between the large dots and the junction part between the small dots, the large and small dots being formed by using the printing head shown in FIG. 5.
Figure 8:
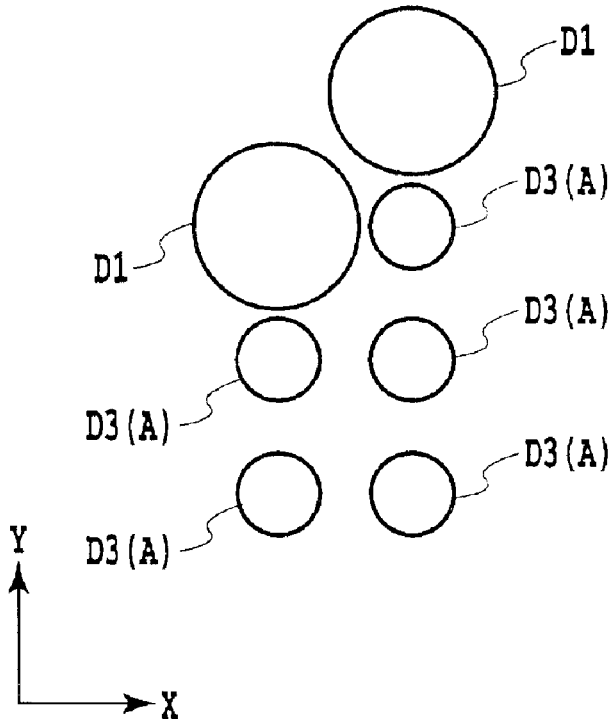
FIG. 8 is a diagram illustrating the dot arrangement, in which the small dots formed without overlapping with the large dot, the large and small dots being formed by using the printing head shown in FIG. 5.

The center of the smaller-diameter nozzle 21A and the center of the larger-diameter nozzle 22 are thus arranged on the imaginary centerline L0 extending along the X direction (main-scanning direction). Accordingly, a small dot D3 and a large dot D1 can each be formed in the center of the print range (pixel) of 600×600 DPI. Thus, when one small dot D3 is formed within the print range, the blank within the print range can be uniformly distributed to the exterior of the periphery of the small dot D3. Consequently, the blank will be unnoticeable. Further, if a combination of large dots D1 and small dots D3 is printed, the junction part between the large dots D1 and the junction part between the small dots D3 deviate from each other in the Y direction (sub-scanning direction), as shown in FIG. 7. That is, the junction part between the large dots D1 is located on a line LA extending along the scanning direction of the printing head 10. The junction part between the small dots D3 is located on a line LB extending along the scanning direction of the printing head 10. These lines LA and LB deviate from each other in the Y direction. As a result, unwanted stripes are hindered from appearing on a printed image. Especially, the center of the smaller-diameter nozzle 21B is preferably arranged on the imaginary centerline L0', as shown in FIG. 5. The imaginary centerline L0' pass through midway between the adjacent larger-diameter nozzles 21 in the Y direction, and extends along the X direction (main-scanning direction). Because, by such arrangement of the smaller-diameter nozzle 21B, as shown in FIG. 7, the small dot D3 formed by the ink droplet ejected through the smaller-diameter nozzle 21B is positioned on the line LA on which the junction part between the large dots D1 is positioned. Therefore, unwanted stripes are hindered more effectively from appearing on a printed image. Further, by the printing head in this embodiment, as shown in FIG. 8, the isolated small dot D3(A) can be formed on the vicinity of the large dot D1 without overlapping with the large dot D1. Therefore, noticeable granularity is not appeared in printed images, high-gradation image can be printed.

Furthermore, in this embodiment, a printing operation can be performed by setting the main scanning speed of the printing head 10 at 20 inch/sec and ejecting ink through each of the larger- and smaller-diameter nozzles 21 and 22 at a driving frequency of 12 kHz. This eliminates the need to increase the driving frequency for the smaller-diameter nozzles 22 even when a middle-sized dot D2 is to be formed. Further, two smaller-diameter nozzles 22 are required to form one middle-sized dots D2. Therefore, the smaller-diameter nozzles 22 become as durable as the larger-diameter nozzles 21.

Figure 22:
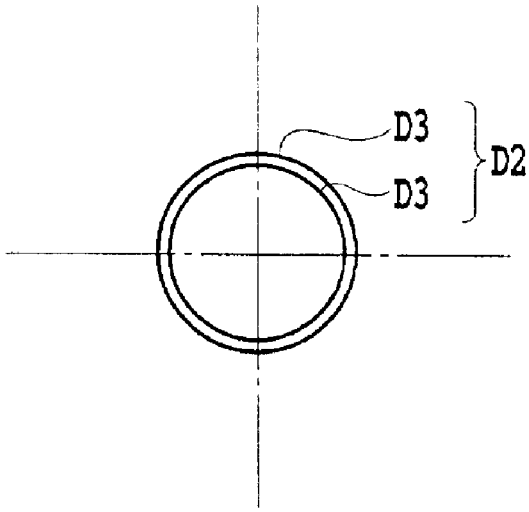
FIG. 22 is a diagram illustrating the dots when small dots are overlapped to form the middle-sized dot by using a conventional printing head.

Furthermore, two smaller-diameter nozzles 22A and 22B located adjacent to each other in the sub-scanning direction shown by the arrow Y can be used to form a middle-sized dot D2 by two small dots D3(A) and D3(B) deviating from each other, as shown in FIG. 6. Thus, a large middle-sized dot D2 can be formed compared to a conventional example in which the conventional printing head is used to place a small dot D3 on another small dot D3 to form a middle-sized dot D2, as shown in FIG. 22. A large middle-sized dot D2 can thus be formed, thereby allowing ink to be reliably fixed to a surface layer of the sheet P. Further, dot area can be efficiently increased relative to the ejecting amount of ink. Furthermore, even if there is a difference in ejecting amount of ink between the smaller-diameter nozzles 22A and 22B because of a manufacture variation in nozzle area, adverse effects can be minimized. That is, a middle-sized dot D2 can be formed to have a stable dot area because it is formed using ink droplets ejected through the two smaller-diameter nozzles 22A and 22B.

In this embodiment, images with photograph-level quality can be formed by properly forming large dots D1, middle-sized dots D2, and small dots D3 as described above.

Furthermore, the printing head 10 of this embodiment can alternately form a large dot D1 using 10 pl of ink droplet ejected through the larger-diameter nozzle 21 and a small dot D3 using 2 pl of ink droplet ejected through the smaller-diameter nozzle 22, in the main scanning direction. By thus forming dots for printing, printing speed can be increased as described below.

Figure 10:
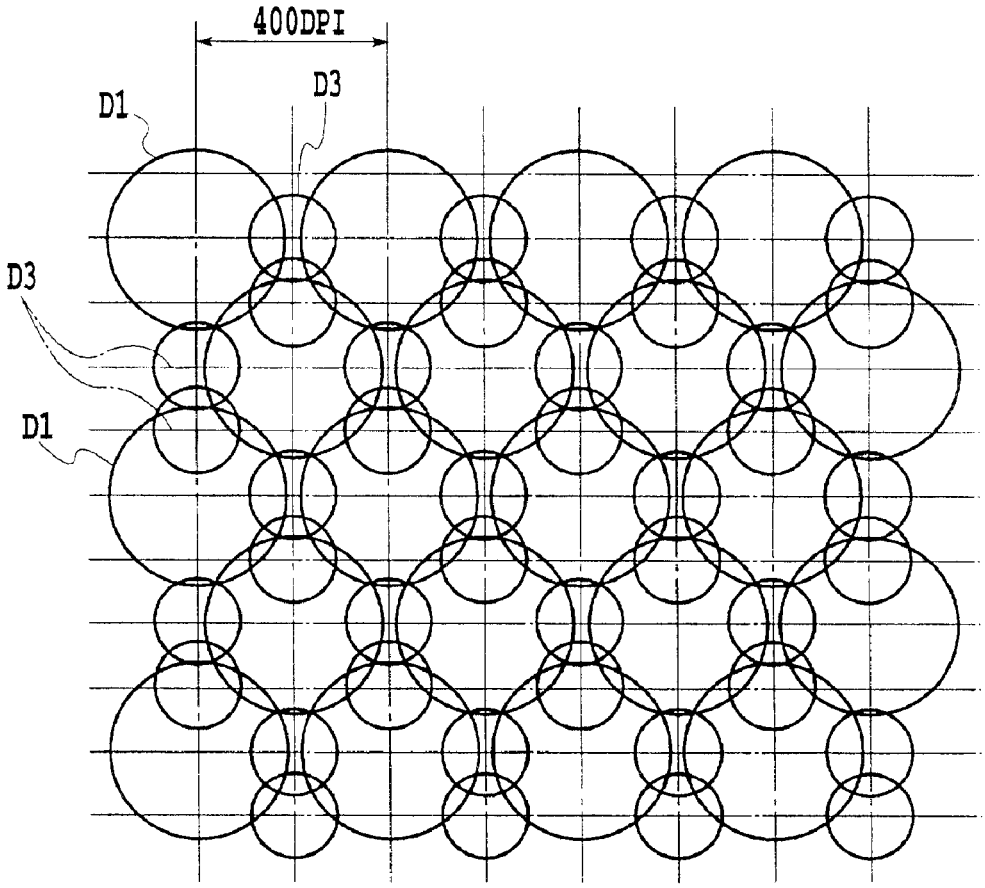
FIG. 10 is a diagram illustrating an example of s combination of large and small dots when the printing head shown in FIG. 5 is used to carry out printing.
Figure 23:
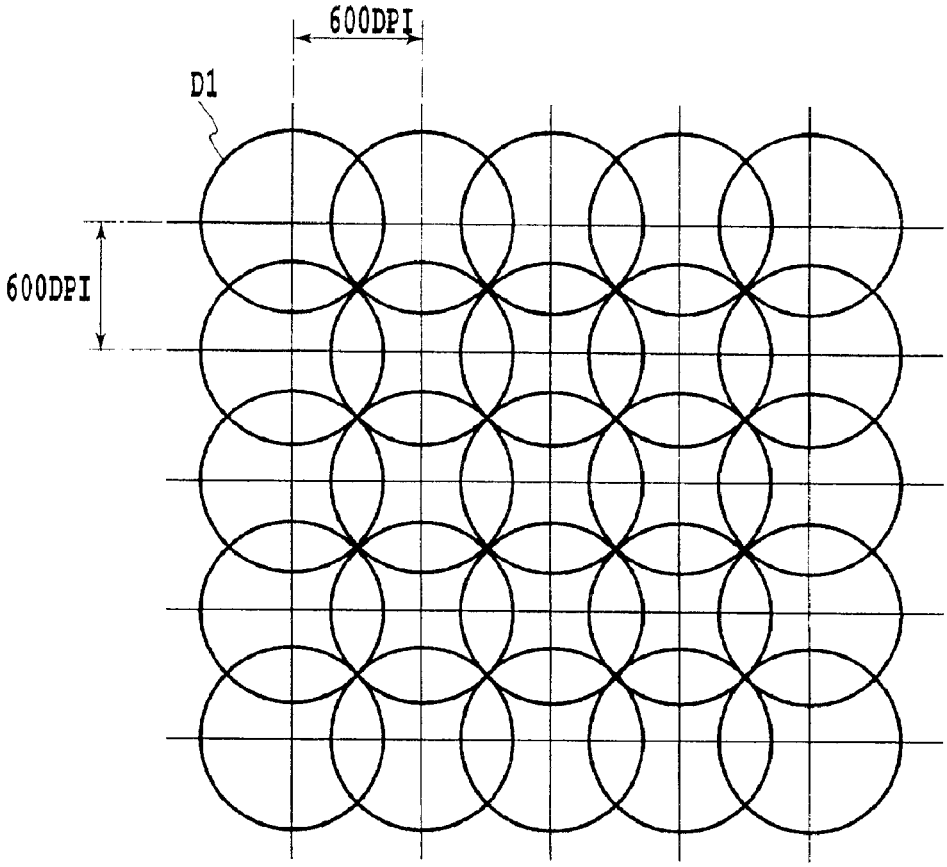
FIG. 23 is a diagram illustrating an example of s combination of the large dots formed using the conventional printing head.

In the prior art, if a print surface on a printing medium is filled with only large dots D1, the distance between the large dots D1 in the main-scanning direction corresponds to a resolution of 600 DPI as shown in FIG. 23. In this embodiment, as shown in FIG. 10, by placing a small dot D3 between the large dots D1, the resolution corresponding to the distance between the large dots D1 in the main-scanning direction can be reduced by the resolution of the small dot D3, 1200 DPI, down to 400 DPI. The resolution of the small dot D3, which determines the resolution between the large dots D1, corresponds to the volume of ink droplets ejected to form a small dot group.

In short, it is necessary to equal an amount of ink to be applied in a unit area on the printing medium, in a part on which large dots D1 are formed and a part on which small dots D3 are formed, for equal the density of ink applied on each parts. In this embodiment, the volume of ink droplet used to form a small dot D3 is 2 pl. The small dot group, constituted by two small dots D2, is formed by 4 pl of ink droplets. The volume of the small dot group, 4 pl, is about half the volume (10 pl) of ink droplets used to form a large dot D1. Consequently, in this embodiment, the resolution of the small dot D3, 1200 DPI, is double the resolution of the large dot D1, 600 DPI.

Thus, when the resolution is 400 DPI in the main-scanning direction, printing speed is three-fourths (=600/400 DPI) as high as that obtained when the resolution is 600 DPI even if the printing head 10 uses the same driving frequency. Further, as shown in FIG. 10, a large dot D1 and a small dot group composed of a plurality of small dots D3 can be alternately formed in the sub-scanning direction (crossing the main-scanning direction). Higher-quality images are obtained by thus distributing large dots D1 and small dots D3.

Figure 9:
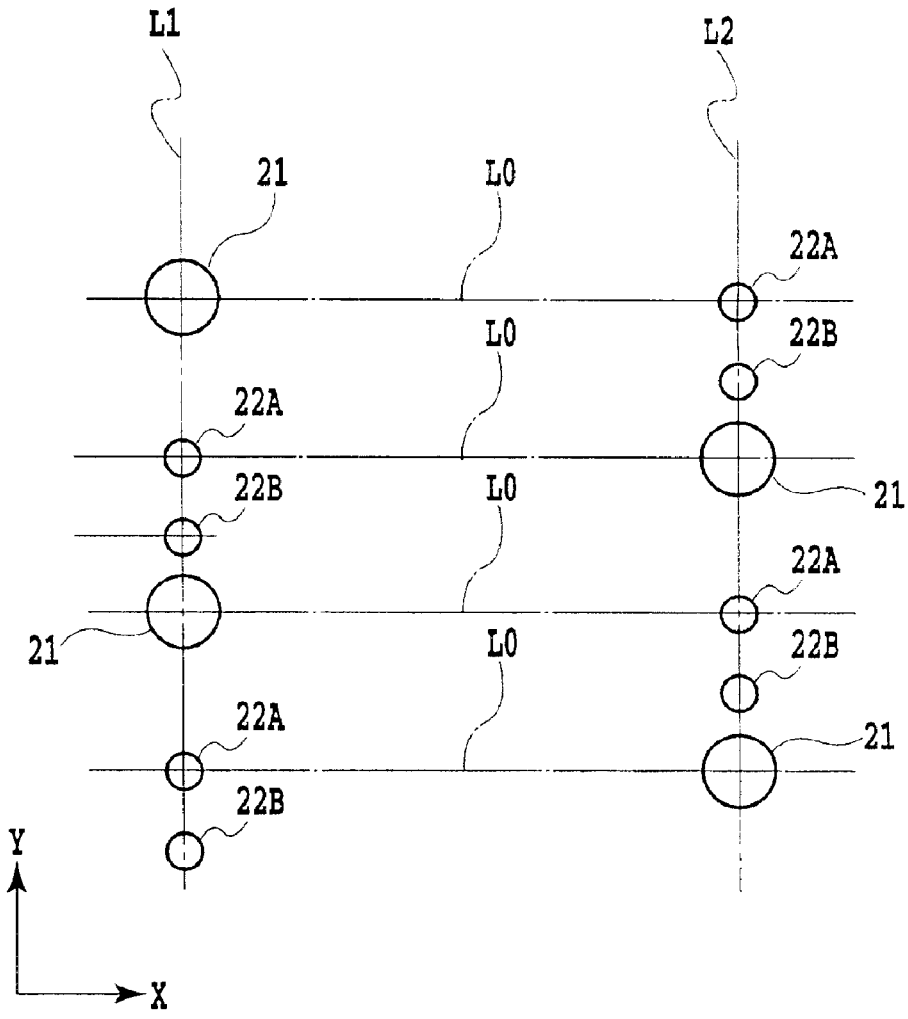
FIG. 9 is a diagram illustrating how nozzles are arranged in another printing head according to a first embodiment of the present invention.

In this embodiment, it is sufficient to arrange the center of the smaller-diameter nozzle 22A on the imaginary centerline L0. The imaginary centerline L0 pass through the center of the larger-diameter nozzle 21 and extends along the X direction (main-scanning direction). Therefore, the structure of the printing head is not limited to that of the printing head, as shown in FIG. 5, larger-diameter nozzle 21 and smaller-diameter nozzle 22 are formed on the different lines L1, L2 respectively. For example, the printing head as shown in FIG. 9 can be structured, the similar effects are obtained. In FIG. 9, the plurality of smaller-diameter nozzles 22 is arranged between the larger-diameter nozzles 21. The printing head shown in FIG. 9 has, as a whole, the plurality of larger-diameter nozzles 21 arranged along the Y direction (sub-scanning direction) at equal intervals and a plurality of the smaller-diameter nozzles 22 arranged along the Y direction (sub-scanning direction) at equal intervals, as is the printing head shown in FIG. 5.

Further, in the ink supply form as shown in FIGS. 1 and 2, ink is supplied from the ink supply port 3 formed on the middle of the substrate to the ink channels formed on both sides of the ink supply port 3. The ink supply form which is applicable to this embodiment is not limited the form as shown in FIGS. 1 and 2. For example, if same color ink is supplied to the ink channels communicated with the larger-diameter nozzles and smaller-diameter nozzles, ink may be supplied from two locations, i.e. the opposite ends of the substrate 4. Furthermore, the ink supply port for supplying ink to ink channel communicated with the larger-diameter nozzles and the ink supply port for supplying ink to ink channel communicated with the smaller-diameter nozzles can be formed separately on the substrate.

(Second Embodiment)

Figure 11:
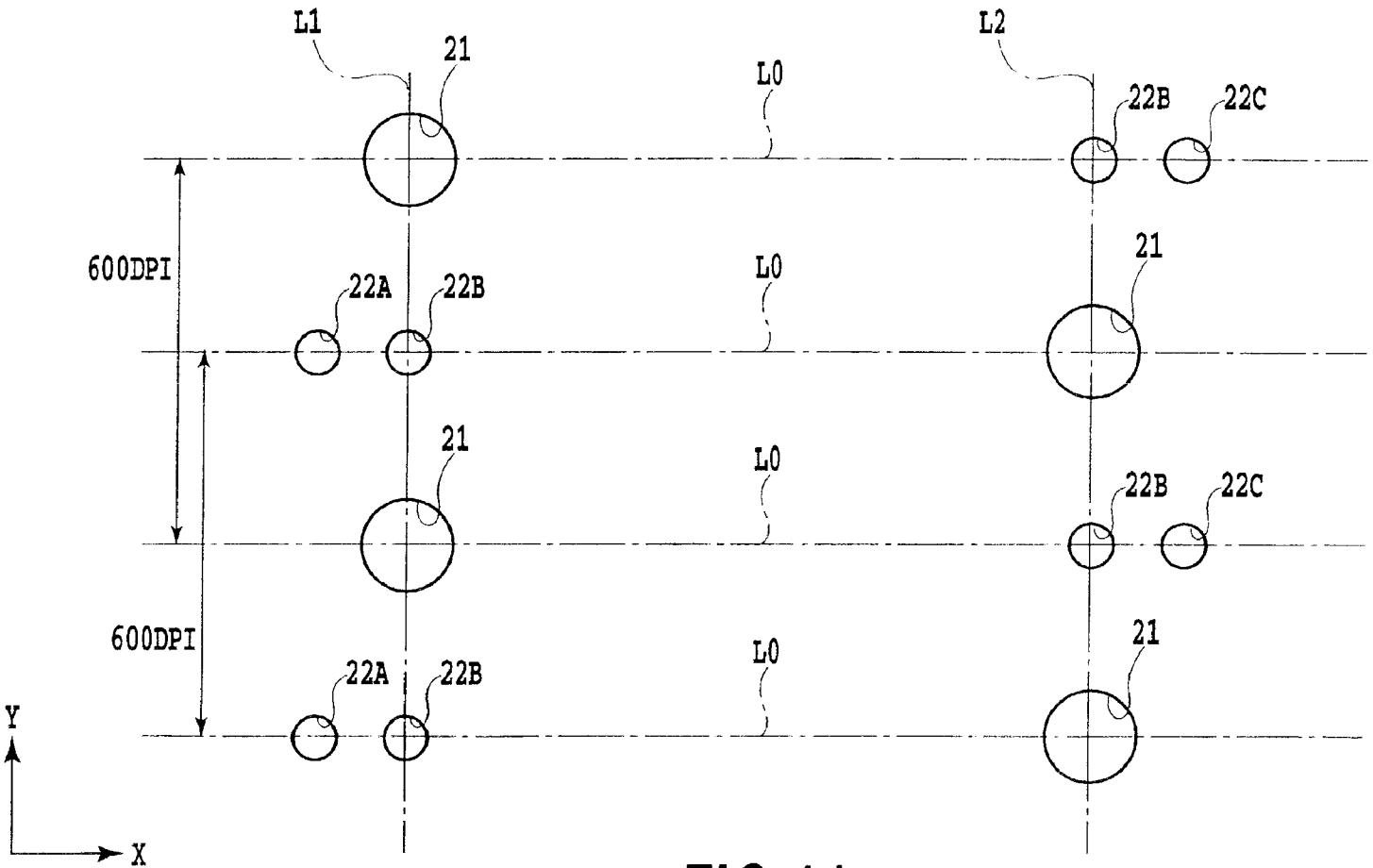
FIG. 11 is a diagram showing how nozzles are arranged in a printing head according to a second embodiment of the present invention.

In this embodiment, larger-diameter nozzles 21 and smaller-diameter nozzles 22 are formed as shown in FIG. 11. The distance between the larger-diameter nozzles 21 corresponds to a resolution of 600 DPI. The distance between the smaller-diameter nozzles 22 also corresponds to a resolution of 600 DPI. On each of the lines L1 and L2, one larger-diameter nozzle 21 alternates with one smaller-diameter nozzle 22. Furthermore, a smaller-diameter nozzle 22A is formed at a position deviating from the smaller-diameter nozzle 22B on the line L1 by a predetermined amount in a −X direction. Moreover, a smaller-diameter nozzle 22C is formed at a position deviating from the smaller-diameter nozzle 22B on the line L2 by a predetermined amount in a +X direction. The center of the larger-diameter nozzle 21 and smaller-diameter nozzles 22 located adjacent to each other in the direction of an arrow X are located on an imaginary centerline L0. That is, one larger-diameter nozzle 21 on the line L1 or L2 and two smaller-diameter nozzles 22 on the line L2 or L1 lie on the same imaginary centerline L0.

Figure 12:
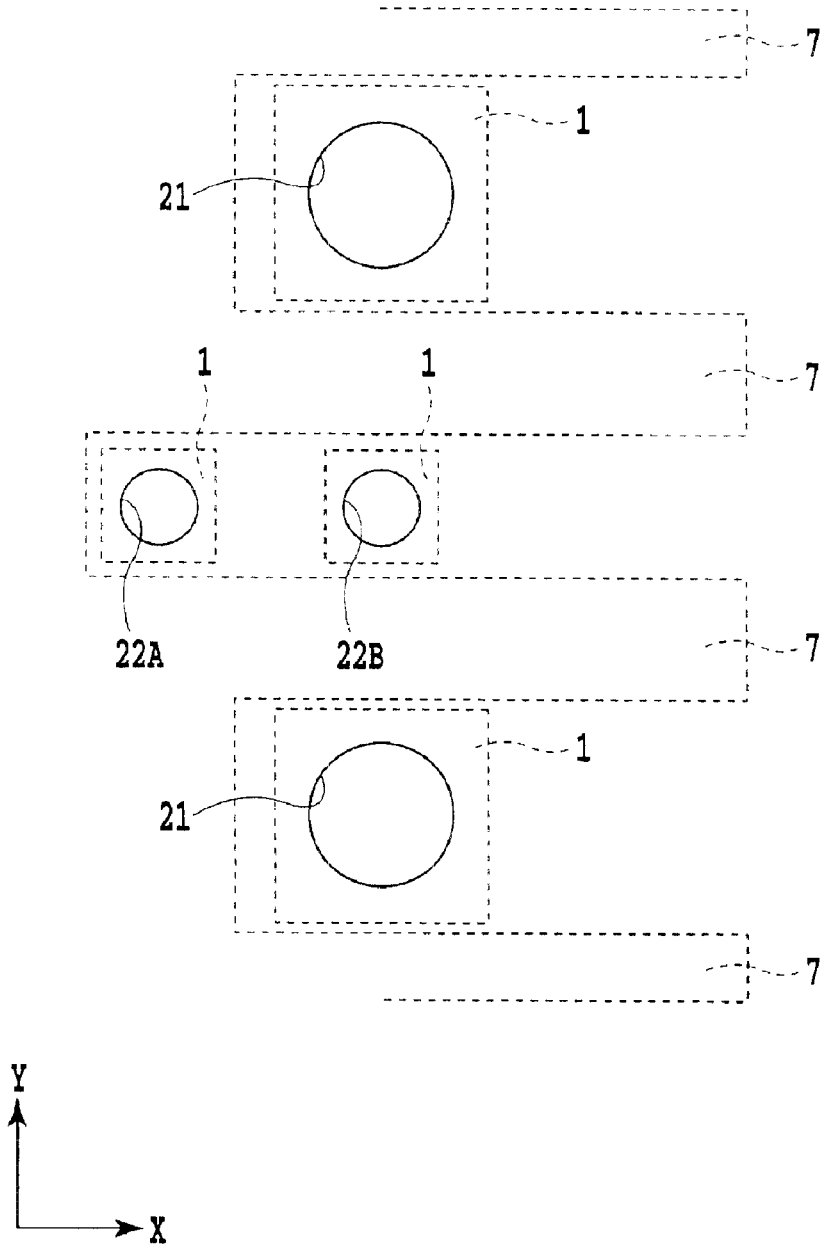
FIG. 12 is a plan view showing nozzles in the printing head in FIG. 11.

FIG. 12 shows the structure of ink channels in the printing head 10 of this example.

On each of the lines L1 and L2, the two smaller-diameter nozzles 22 arranged adjacent to each other in the direction of the arrow X are in communication with a common ink channel. The common ink channel is provided with the electrothermal conversion elements 1 corresponding to the two smaller-diameter nozzles 22, respectively. Accordingly, one common ink channel 7 is provided with two smaller-diameter nozzles 22 and two electrothermal conversion elements 1.

Figure 13:
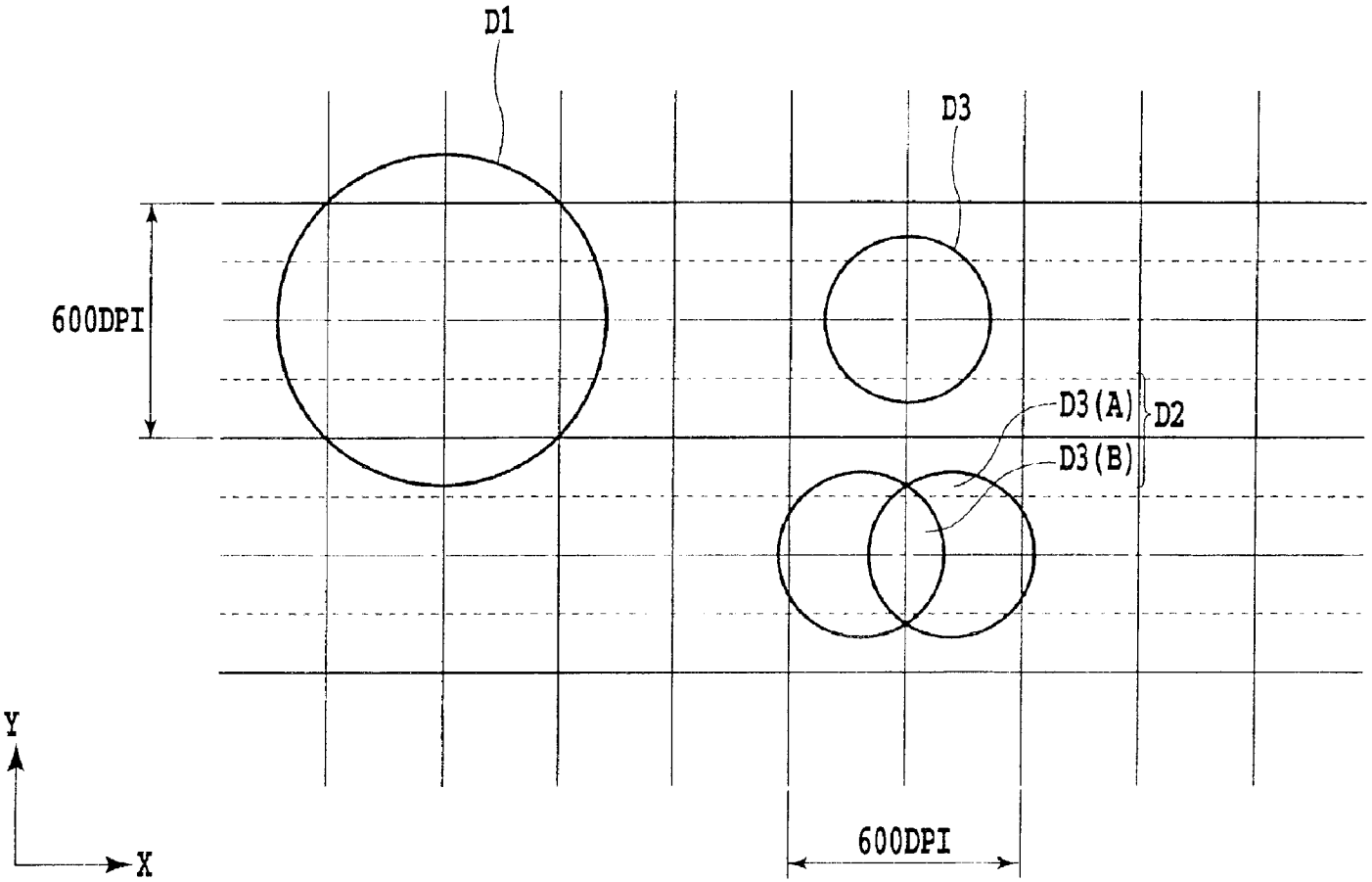
FIG. 13 is a diagram illustrating dots that can be formed using the printing head shown in FIG. 11.

With the printing head 10 of this example, within a unit print area of 600×600 DPI, a large dot D1 is formed by an ink droplet ejected through the larger-diameter nozzle 21, and a small dot D3 is formed by an ink droplet ejected through the smaller-diameter nozzle 22, as shown in FIG. 13. In FIG. 13, D3(A) denotes a small dot formed by an ink droplet ejected through the smaller-diameter nozzle 22A. D3(B) denotes a small dot formed by an ink droplet ejected through the smaller-diameter nozzle 22B. Further, a middle-sized dot D2 is formed by ink droplets ejected through two smaller-diameter nozzles 22 located on each of the lines L1 and L2 adjacent to each other in the direction of the arrow X. That is, the middle-sized dot D2 is formed by two small dots D3. The middle-sized dot D2 in FIG. 13 is formed by the small dots D3(A) and D3(B).

Thus, in this embodiment, as in the first embodiment, the center of the smaller-diameter nozzle 21A is located on the imaginary centerline L0, which extends along the X direction (main-scanning direction) through the center of the larger-diameter nozzle 22. Accordingly, a small dot D3 and a large dot D1 can each be formed in the center of a print range (pixel) of 600×600 DPI. Thus, when one small dot D3 is formed within the print range, the blank within the print range can be uniformly distributed to the exterior of the periphery of the small dot D3. Consequently, the blank will be unnoticeable. Further, if a combination of large dots D1 and small dots D3 is printed, the junction part between the large dots D1 and the junction part between the small dots D3 deviate from each other in the Y direction (sub-scanning direction). As a result, unwanted stripes are hindered from appearing on a printed image. Further, a middle-sized dot D2 can be formed by placing ink droplets ejected through a plurality of smaller-diameter nozzles 22, on each other so that the ink droplets deviate from each other.

A method of forming a large dot D1, a middle-sized dot D2, or a small dot D3 is similar to the one described in the first embodiment. In this embodiment, the printing resolution of the large dot D1 can be increased in the direction of the arrow Y (sub-scanning direction). Therefore, images can be printed with an increased definition.

The printing head 10 is filled with ink from an ink storage section including ink tanks 54, through a filling operation based on ink suction or pressurization carried out by the ink-jet printing apparatus. The ink is then filled into the nozzles 21 and 22 via the ink supply port 3. When in each of the lines L1 and L2, one larger-diameter nozzle 21 alternates with two smaller-diameter nozzles 22, as in this example, ink has an equal viscous resistance in both nozzle line L1 and nozzle line L2. Accordingly, in this embodiment, through the filling operation based on ink suction or pressurization carried out by the ink-jet printing apparatus, the nozzles 21 and 22 can be reliably filled with ink without causing bubbles to remain in the ink supply port 3 or the like. Further, instead of the ink supply form in which ink is supplied through the ink supply port 3, formed in the center of the substrate 4, as shown in FIGS. 1 and 2, ink may be supplied from two locations, i.e. the opposite ends of the substrate 4. Both supply forms produce similar effects.

(Third Embodiment)

Figure 14:
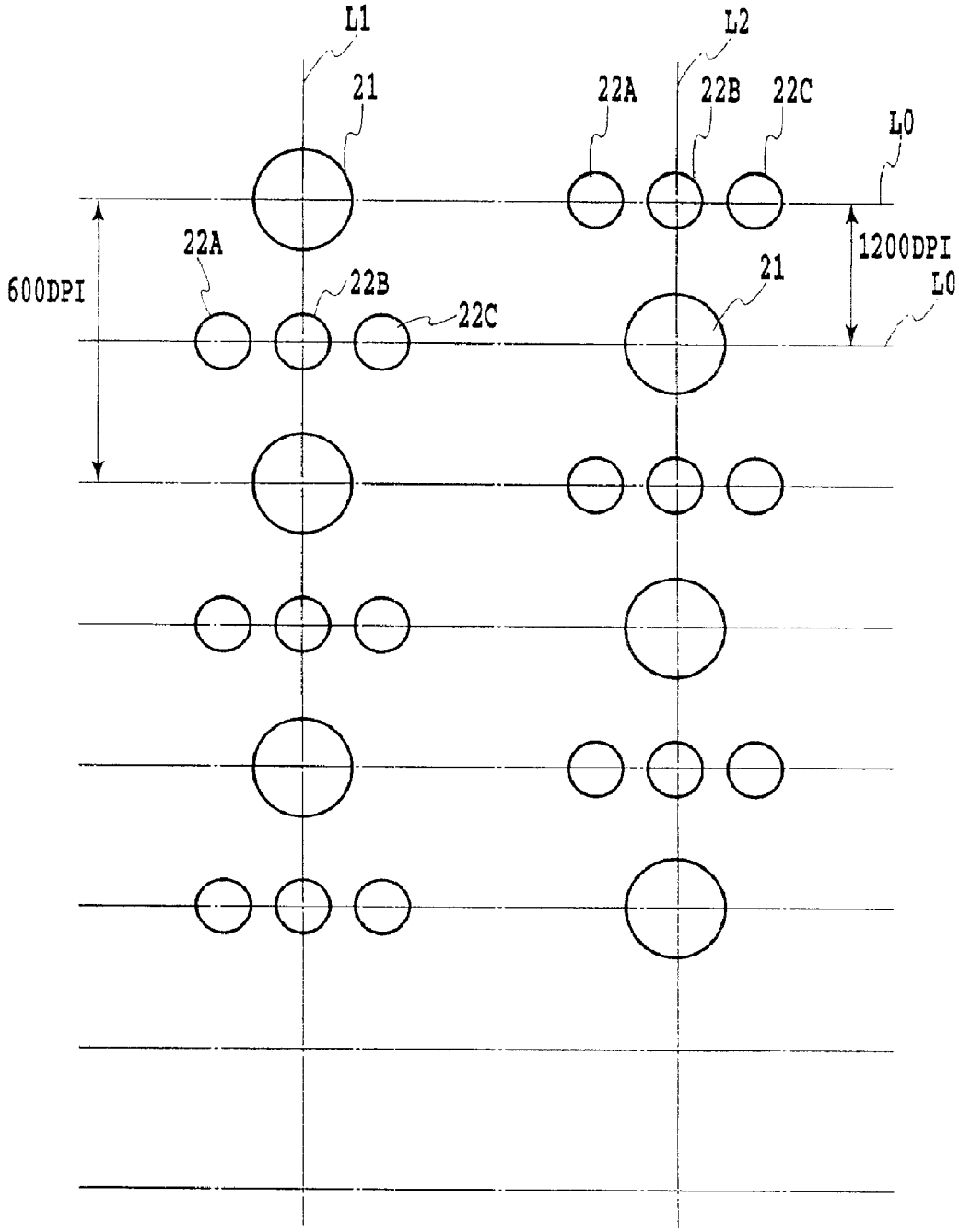
FIG. 14 is a diagram showing how nozzles are arranged in a printing head according to a third embodiment of the present invention.

FIG. 14 shows how nozzles are arranged in an ink-jet printing head according to a third embodiment of the present invention. Further, FIG. 15 shows the arrangement of dots that can be formed using this printing head.

In this embodiment, as shown in FIG. 14, the three smaller-diameter nozzles 22 (22A, 22B, and 22C) are arranged on the centerline L0 of the larger-diameter nozzle extending along the main-scanning direction.

The distance between the larger-diameter nozzles 21 corresponds to a resolution of 600 DPI. The distance between the smaller-diameter nozzles 22 corresponds to a resolution of 600 DPI. The volume of ink droplets ejected through the larger-diameter nozzle 21 is 6 pl. The volume of ink droplets ejected through the smaller-diameter nozzle 22 is 2 pl. Both the resolution of the larger-diameter nozzle 21 on the lines L1 and L2 and the resolution of the smaller-diameter nozzle 22 on the lines L1 and L2 are 1200 DPI. The center of the larger-diameter nozzle 21 coincides with the smaller-diameter nozzles 22B on each of the lines L1 and L2. Further, the center of the larger-diameter nozzle 21 on the line L1 or L2 and the center of the smaller-diameter nozzles 22 (22A, 22B, and 22C) on the line L2 or L1 are located on the same imaginary line L0.

Figure 15:
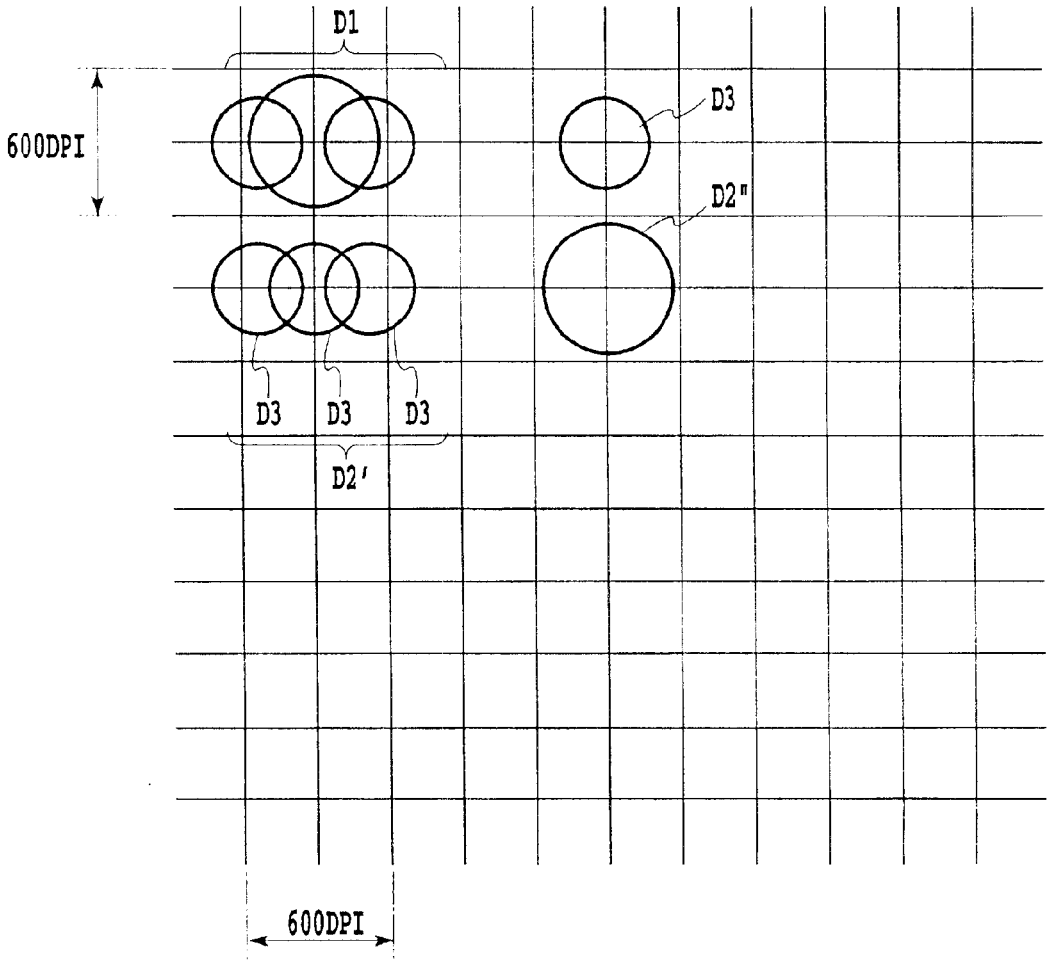
FIG. 15 is a diagram illustrating dots that can be formed using the printing head shown in FIG. 14.

With the printing head 10 of this example, within a unit print area of 600×600 DPI, a large dot D1, middle-sized dots D2' and D2", and a small dot D3 can be formed as shown in FIG. 15. The large dot D1 is formed by ink droplets ejected through the larger-diameter nozzle 21 and two smaller-diameter nozzles 22A and 22C. The larger-diameter nozzle 21 is located on the line L1 or L2, whereas the smaller-diameter nozzles 22A and 22C are located on the line L2 or L1, respectively, and on the same raster with that of the larger-diameter nozzle 21. Further, a small dot D3 is formed by an ink droplet ejected through the smaller-diameter nozzle 22B. Two forms of middle-sized dots are formed.

One of them, the middle-sized dot D2' is formed by ink droplets ejected through the three smaller-diameter nozzles 22A, 22B, and 22C. The other form, the middle-sized dot D2" is formed by an ink droplet ejected through the larger-diameter nozzle 21.

The printing head 10 is filled with ink from an ink storage section including the ink tanks 54 and others, through a filling operation based on ink suction or pressurization carried out by the ink-jet printing apparatus. The ink is then filled into the nozzles 21 and 22 via the ink supply port 3. When in each of the lines L1 and L2, one larger-diameter nozzle 21 alternates with three smaller-diameter nozzles 22, ink has an equal viscous resistance in both nozzle line L1 and nozzle line L2. Accordingly, in this embodiment, through the filling operation based on ink suction or pressurization carried out by the ink-jet printing apparatus, the nozzles 21 and 22 can be reliably filled with ink without causing bubbles to remain in the ink supply port 3 or the like. Further, instead of the ink supply form in which ink is supplied through the ink supply port 3, formed in the center of the substrate 4, as shown in FIGS. 1 and 2, ink may be supplied from two locations, i.e. the opposite ends of the substrate 4. Both supply forms produce similar effects.

In this manner, in this embodiment, the number of smaller-diameter nozzles 22 is three times as large as that of larger-diameter nozzles 21. Further, the center of the larger-diameter nozzle 21 on the line L1 or L2 coincides with the center of the three smaller-diameter nozzles 22A, 22B, and 22C on the line L2 or L1, respectively (centerline L0). This serves to increase the resolution of the larger-diameter nozzle 21 in the X direction (main-scanning direction) to allow images to be printed with a higher definition.

Further, in this embodiment, as in the first embodiment described previously, a small dot D3 and a large dot D1 can each be formed in the center of a print range (pixel) of 600×600 DPI. Thus, when one small dot D3 is formed within the print range, the blank within the print range can be uniformly distributed to the exterior of the periphery of the small dot D3. Consequently, the blank will be unnoticeable. Further, the junction part between the large dots D1 and the junction part between the small dots D3 deviate from each other in the Y direction (sub-scanning direction). As a result, unwanted stripes are hindered from appearing on a printed image.

Furthermore, the amount of ink ejected through the one larger-diameter nozzle 21 equals the sum of the amounts of ink ejected through the three smaller-diameter nozzles 22A, 22B, and 22C. Thus, a driving frequency used to form a large dot may be the same as that used to form a middle-sized dot D2" using only an ink droplet ejected through the larger-diameter nozzle 21. This eliminates the need to increase the driving frequency for the smaller-diameter nozzles 22 even when a large dot is to be formed. Furthermore, a driving frequency used to form a middle-sized dot D2' using three ink droplets ejected through the three smaller-diameter nozzles 22A, 22B, and 22C may be the same as that used to form a middle-sized dot D2" using only an ink droplet ejected through the larger-diameter nozzle 21. This enables images to be printed at high speed without increasing the driving frequency for the smaller-diameter nozzles 22.

(Fourth Embodiment)

Figure 16A:
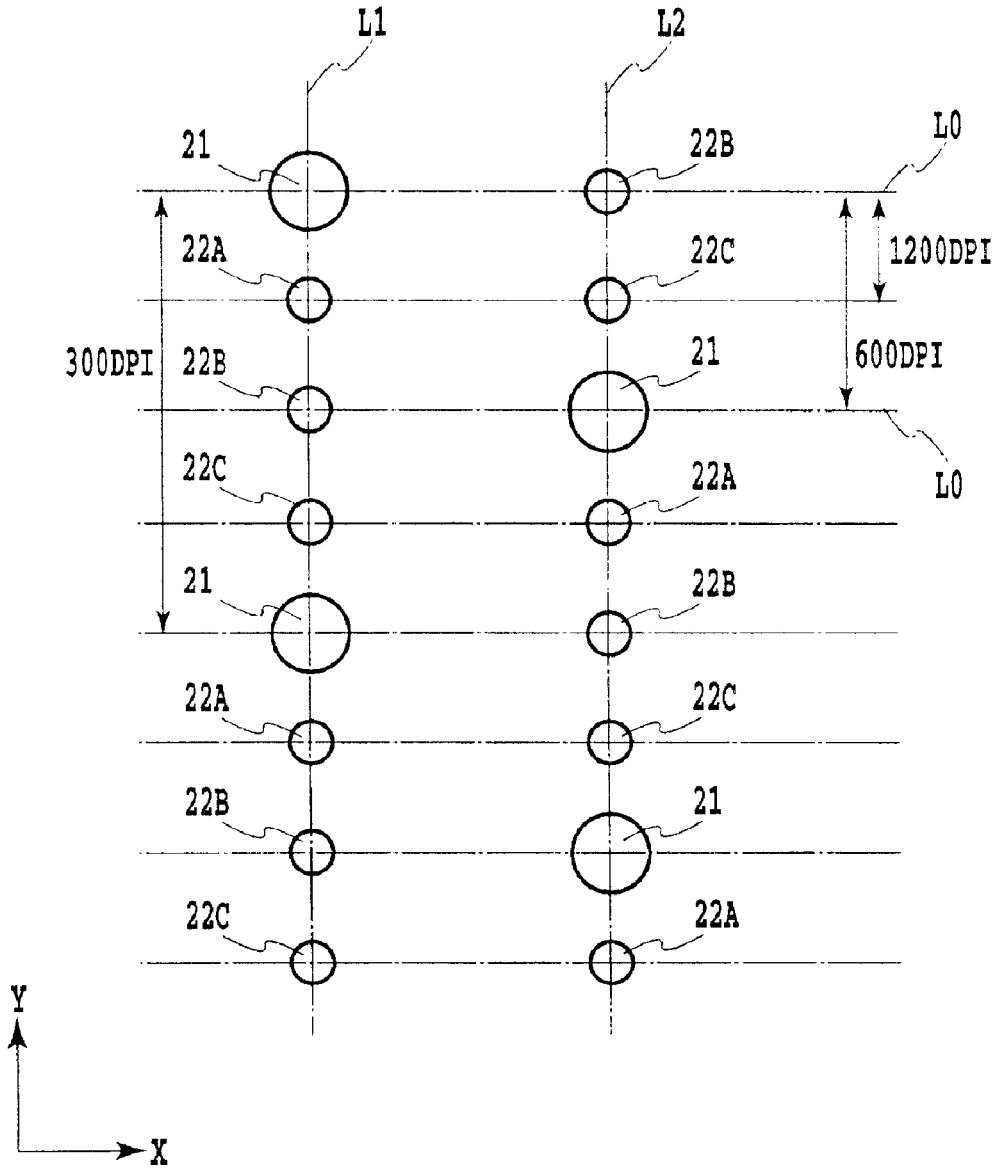
FIG. 16A is a plan view showing an example of a configuration of a printing head according to a fourth embodiment of the present invention.
Figure 16B:
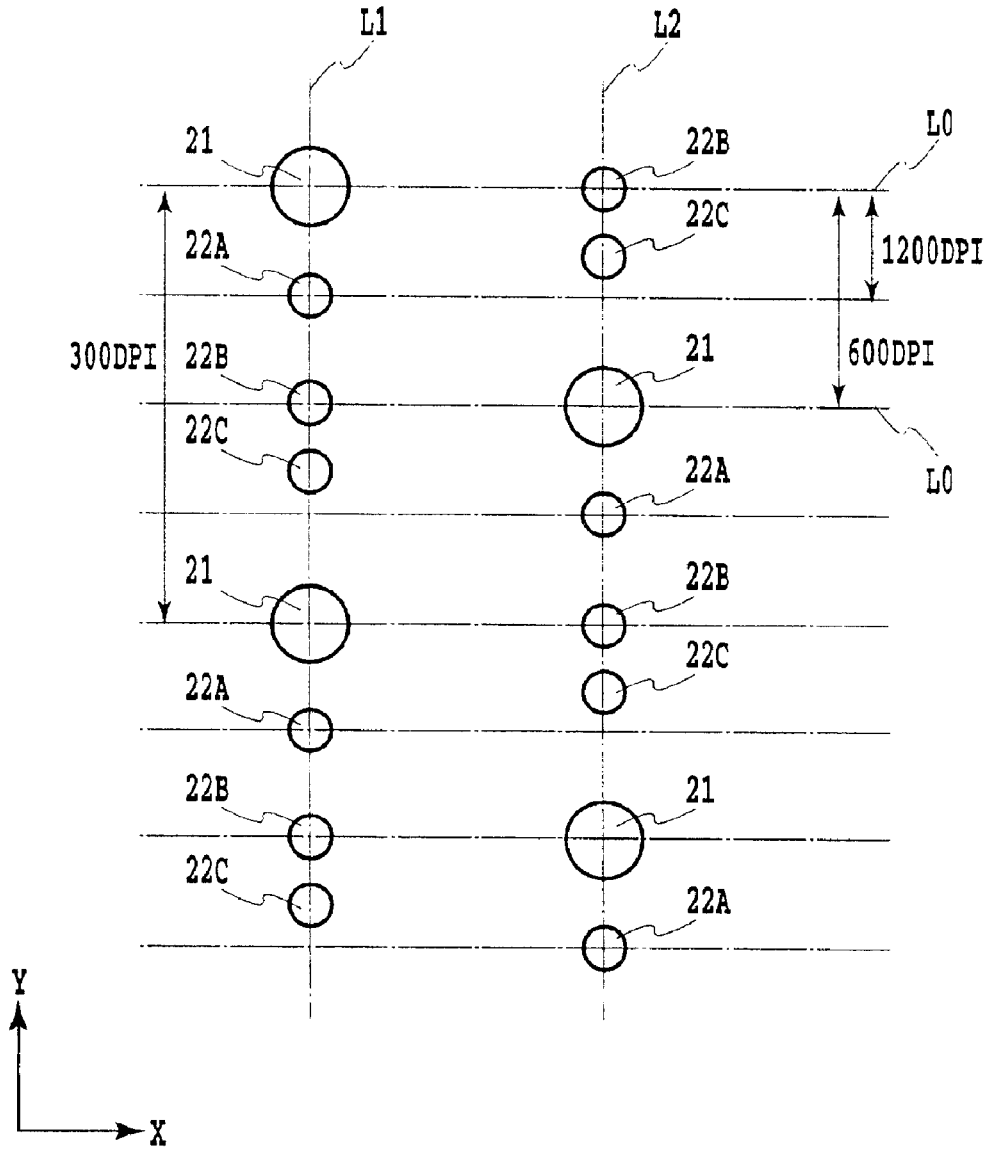
FIG. 16B is a plan view showing another example of a configuration of the printing head according to the fourth embodiment of the present invention

In this embodiment, the larger-diameter nozzles and the smaller-diameter nozzles are formed on the same line. On this line, three smaller-diameter nozzles are arranged between two larger-diameter nozzles. These nozzles may be arranged as shown in FIG. 16A or 16B. FIGS. 16A and 16B are plan views of an essential part of an ink-jet printing head according to this embodiment.

In FIGS. 16A and 16B, the distance between the larger-diameter nozzle 21 on the line L1 and the larger-diameter nozzle 21 on the line L2 corresponds to a resolution of 600 DPI. Further, in each of the lines L1 and L2, the distance between two larger-diameter nozzles 21 corresponds to a resolution of 300 DPI. The center of the larger-diameter nozzle 21 on the line L1 or L2 coincides with the center of the smaller-diameter nozzle 22B on the line L2 or L1, respectively (centerline L0).

Further, in FIG. 16A, the distance between two of the three smaller-diameter nozzles 22A, 22B, and 22C, located between two larger-diameter nozzles 21, corresponds to a resolution of 1200 DPI. In FIG. 16B, the distance between the smaller-diameter nozzle 22A on the line L1 or L2 and the smaller-diameter nozzle 22B on the line L2 and L1, respectively, corresponds to a resolution of 1200 DPI. The smaller-diameter nozzle 22C is arranged at the intermediate position between these smaller-diameter nozzles 22A and 22B in the Y direction.

Also in this embodiment, as in the first embodiment described previously, the center of the smaller-diameter nozzle 22(22B) is located on the imaginary centerline L0 extending along the X direction (main-scanning direction) through the center of the larger-diameter nozzle 21. Accordingly, a small dot D3 and a large dot D1 can each be formed in the center of the print range (pixel). Thus, when one small dot D3 is formed within the print range, the blank within the print range can be uniformly distributed to the exterior of the periphery of the small dot D3. Consequently, the blank will be unnoticeable. Further, if a combination of large dots D1 and small dots D3 is printed, the junction part between the large dots D1 and the junction part between the small dots D3 deviate from each other in the Y direction (sub-scanning direction). As a result, unwanted stripes are hindered from appearing on a printed image.

In the ink-jet printing head shown in FIGS. 16A and 16B, ink from the ink storage section (not shown) is filled into the nozzles via the ink supply port through a sucking or pressurizing operation performed by the ink-jet printing apparatus, as in the embodiments described previously.

In this embodiment, one larger-diameter nozzle 21 alternates with three smaller-diameter nozzles 22A, 22B, and 22C on the same line. Accordingly, ink can be filled into the nozzles through a sucking or pressurizing operation performed by the ink-jet printing apparatus, while preventing bubbles from remaining in the ink supply port or in other areas. Further, in this embodiment, the ink supply port is formed in the center of the substrate. However, similar effects are produced if ink is supplied from two locations, i.e. the opposite ends of the substrate. Furthermore, in this embodiment, the ink-jet printing head FIGS. 16A and 16B performs a printing operation while scanning a printing medium a speed of 20 inch/sec in the direction of the arrow X (main-scanning direction). The volume of ink ejected through the larger-diameter nozzle 21 is 10 pl. The volume of ink ejected through the smaller-diameter nozzle 22 (22A, 22B, or 22C) is 2 pl.

Figure 17A:
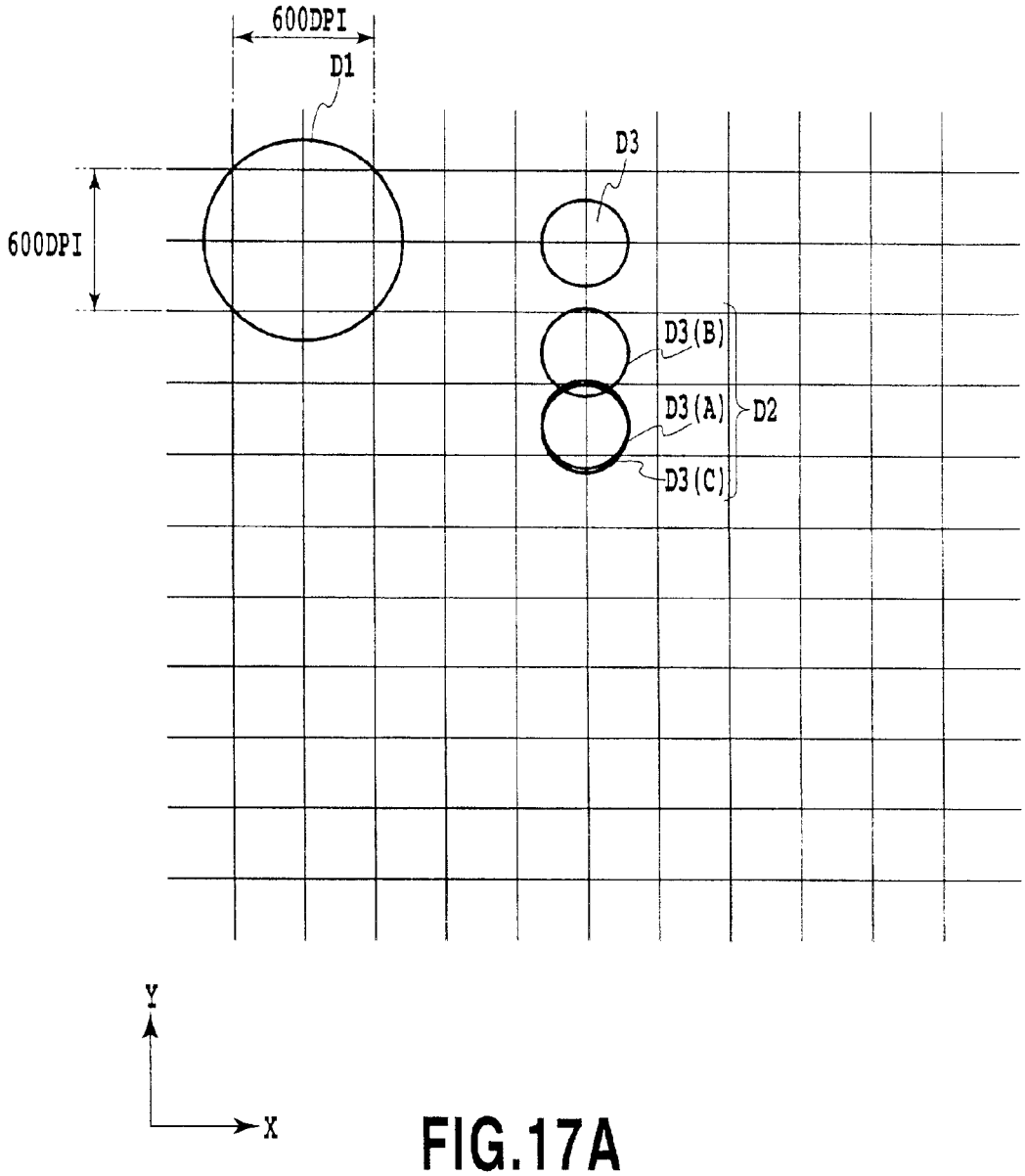
FIG. 17A is a diagram illustrating dots that can be formed using the printing head shown in FIG. 16A.
Figure 17B:
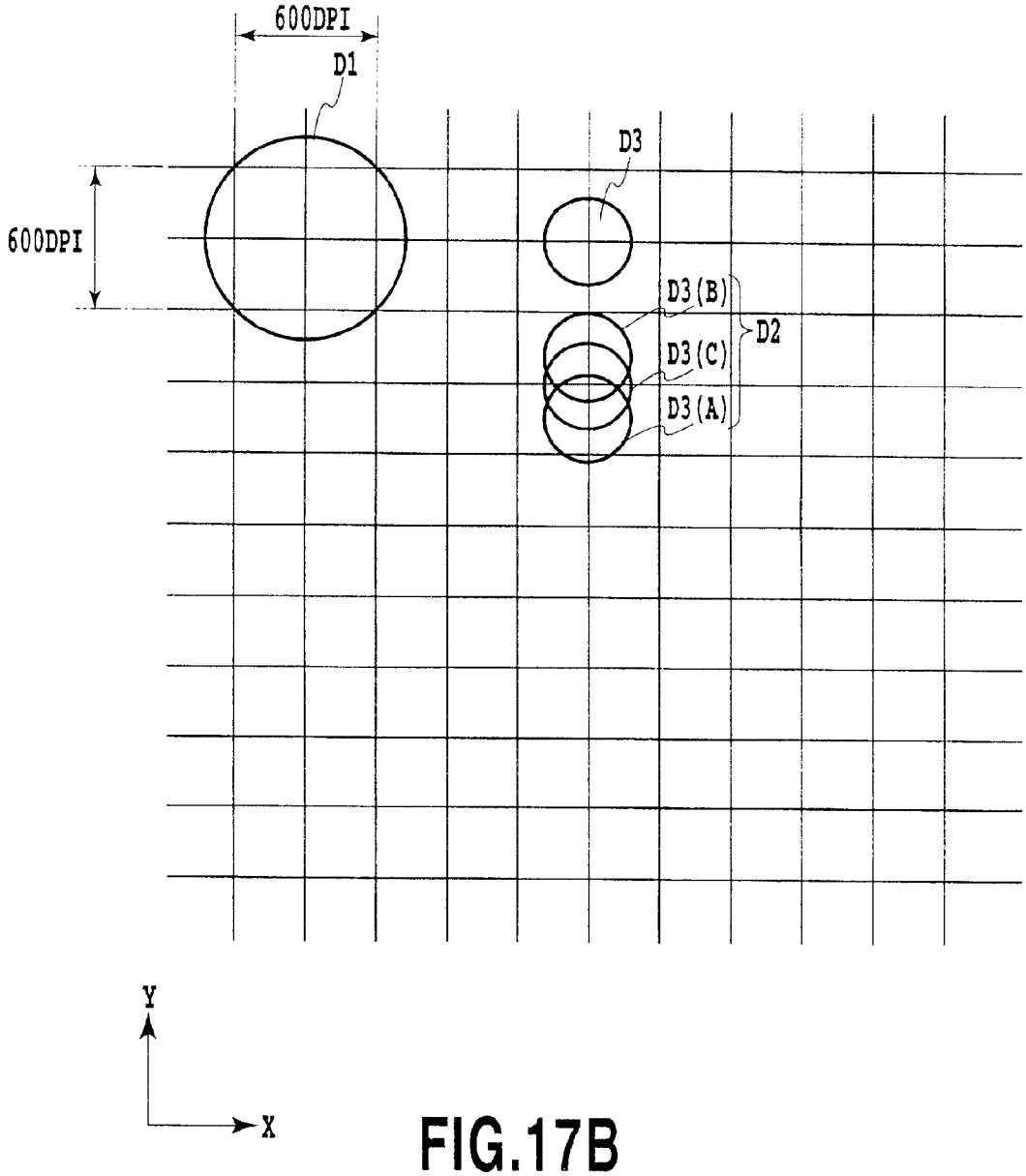
FIG. 17B is a diagram illustrating dots that can be formed using the printing head shown in FIG. 16B.

FIG. 17A is a diagram illustrating the arrangement of dots formed using the printing head shown in FIG. 16A. FIG. 17B is a diagram illustrating the arrangement of dots formed using the printing head shown in FIG. 16B. Within a unit print area of 600×600 DPI, a large dot D1 is formed by an ink droplet ejected through the larger-diameter nozzle 21, and a small dot D3 is formed by an ink droplet ejected through the smaller-diameter nozzle 22 (22A, 22B, or 22C).

Further, a middle-sized dot D2 is formed by ink droplets ejected through the three smaller-diameter nozzles 22A, 22B, and 22C. In FIGS. 17A and 17B, small dots D3(A), D3(B), and D3(C) are formed by ink droplets ejected through the three smaller-diameter nozzles 22A, 22B, and 22C, respectively. The middle-sized dot D2 is formed by these three dots D3(A), D3(B), and D3(C). In this case, a printing operation can be performed by causing the printing head to perform a main-scanning operation at a speed of 20 inch/sec and ejecting ink through each of the larger-diameter nozzles 21 and smaller-diameter nozzles 22 (22A, 22B, and 22C) with a driving frequency of 12 kHz. This eliminates the need to increase the driving frequency for the smaller-diameter nozzles 22 even when the middle-sized dot D2 is to be formed.

Further, the middle-sized dot D2 is formed as shown in FIG. 17B when the smaller-diameter nozzles 22B and 22C deviate by half the resolution of the smaller-diameter nozzles 22 as shown in FIG. 16B. When the middle-sized dot D2 is formed in this manner, both unwanted stripes in a printed image and the nonuniform density thereof are avoided even if ink droplets forming these small dots D3 imprecisely land on the printing medium in the Y direction. Furthermore, large middle-sized dots D2 are stably obtained, and high-grade images can be printed. In this embodiment, the number of smaller-diameter nozzles 22 is three times as large as that of larger-diameter nozzles 21. Accordingly, throughput is prevented from decreasing even if a photograph-grade image is to be printed.

(Other Embodiment)s

Figure 18:
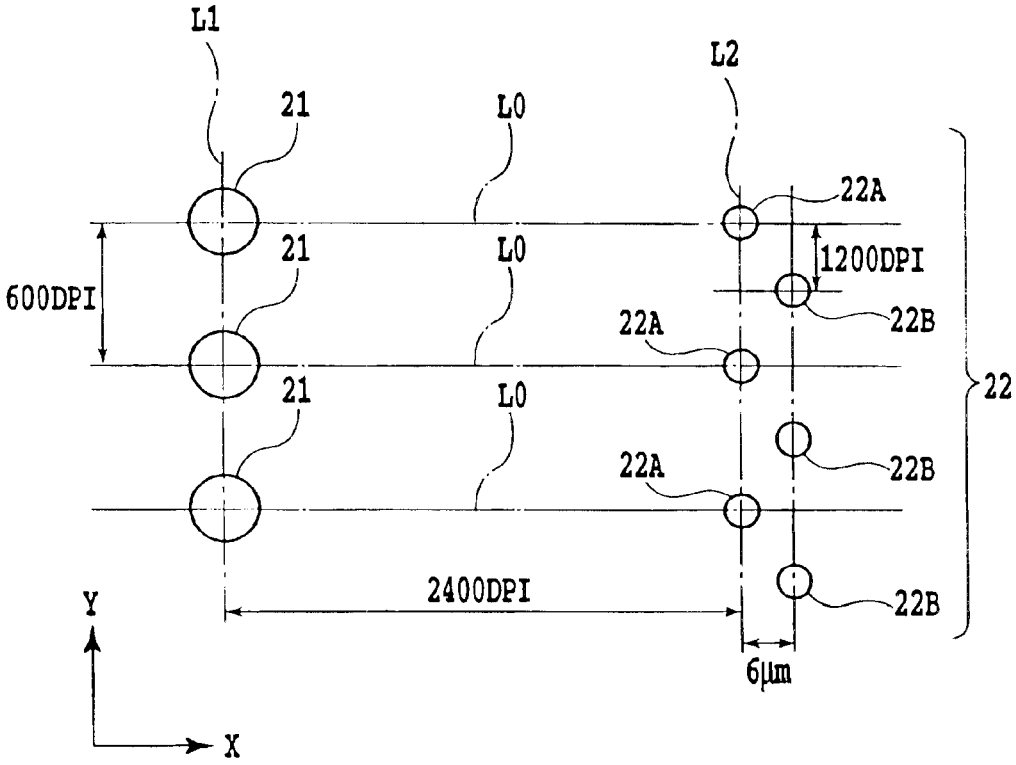
FIG. 18 is a plan view showing an example of a configuration of a printing head according to another embodiment of the present invention.
Figure 19:
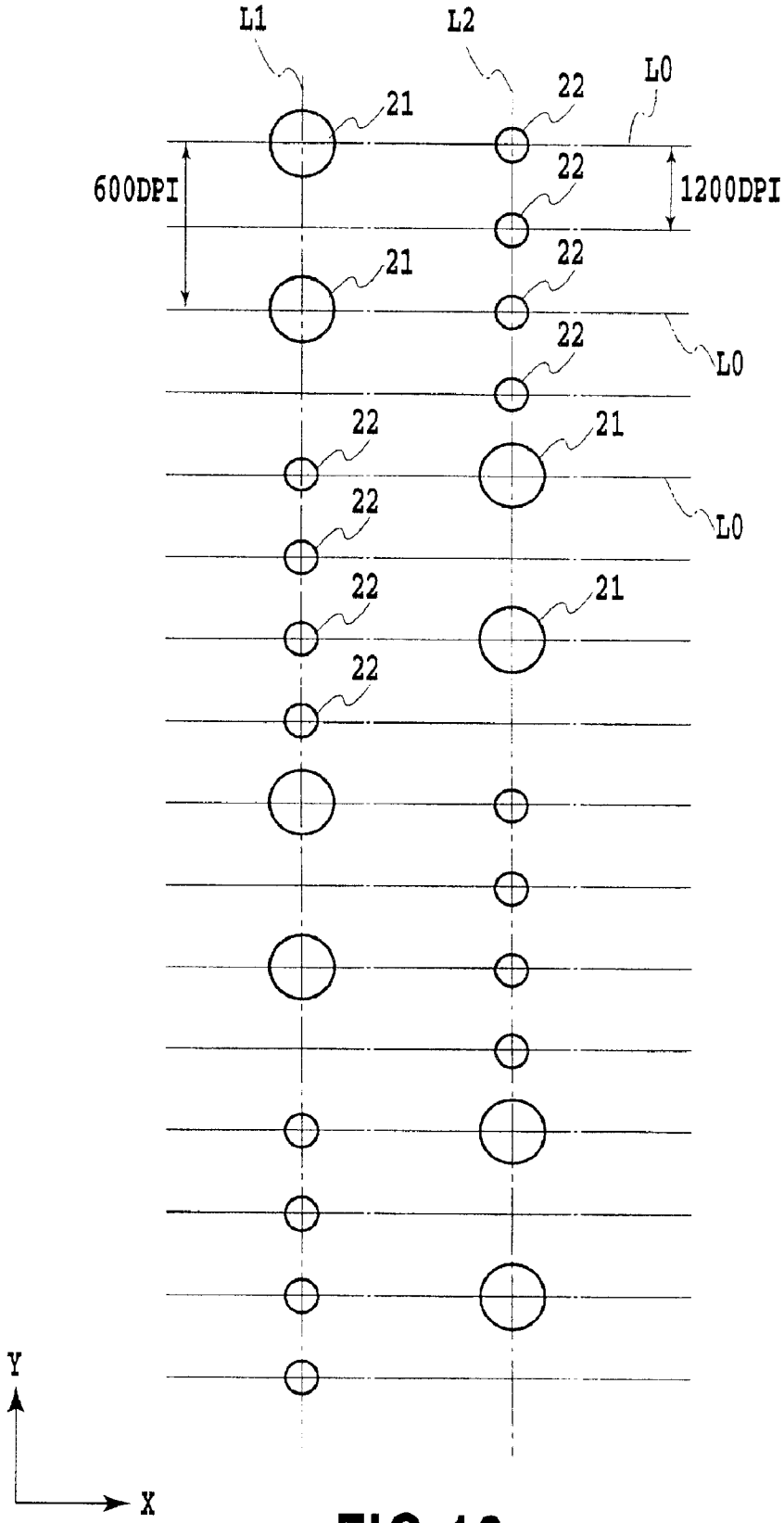
FIG. 19 is a plan view showing another example of a configuration of a printing head according to another embodiment of the present invention.
Figure 20:
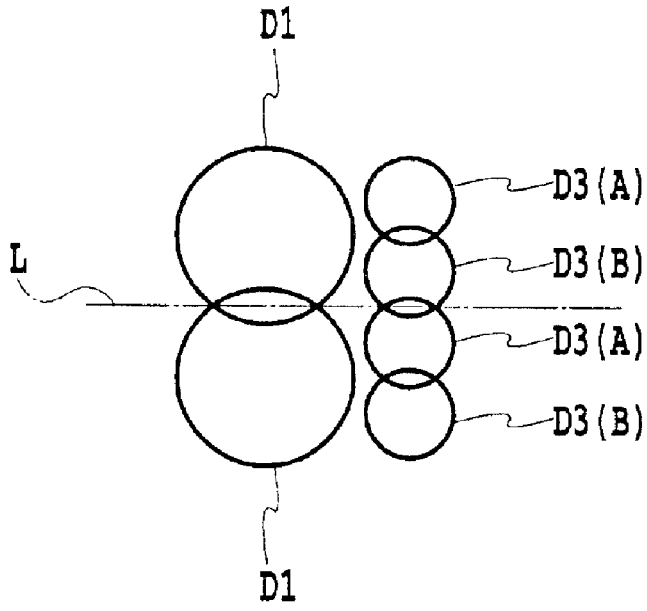
FIG. 20 is a diagram illustrating the junction part between the large dots and the junction part between the small dots, the large and small dots being formed by using a conventional printing head.
Figure 21:
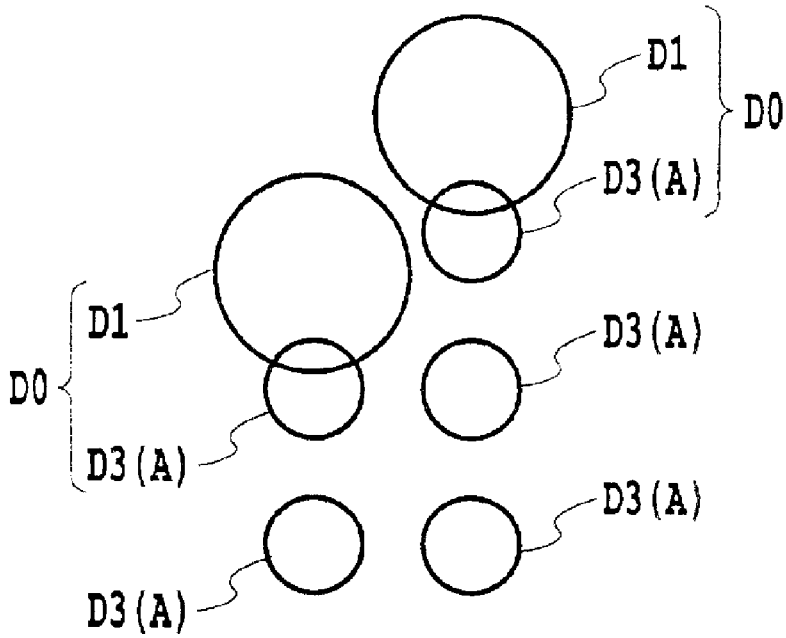
FIG. 21 is a diagram illustrating the overlapping of the large dots and small dots, the large and small dots being formed by using a conventional printing head.

In the ink-jet printing head of the present invention, the larger- and smaller-diameter nozzles 21 and 22 have only to be arranged so that at least one set of smaller-diameter nozzles 22 has its centers located on the imaginary center-lines L0 extending in the main-scanning direction through the centers of the larger-diameter nozzles 21. Accordingly, the nozzles 21 and 22 may be arranged as shown in FIGS. 18 and 19. In FIG. 18, the center positions of the smaller-diameter nozzles 22B deviate from both imaginary line L0 and line L2. Further, in FIG. 19, a plurality of larger-diameter nozzles 21 alternate with a plurality of smaller-diameter nozzles 22 on each of the lines L1 and L2.

With a printing head with the nozzles arranged as shown in FIG. 18 or 19, when one small dot is formed within a print range, the blank within the print range can be uniformly distributed to the exterior of the periphery of the small dot D3. Consequently, the blank will be unnoticeable. Further, if a combination of large dots D1 and small dots D3 is printed, the junction part between the large dots D1 and the junction part between the small dots D3 deviate from each other in the Y direction (sub-scanning direction). As a result, unwanted stripes are hindered from appearing on a printed image. Therefore, these printing heads also enable photograph-grade images to be printed.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink-jet printing head having a plurality of nozzles through which said printing head ejects ink droplets of the same color while moving in a scanning direction, wherein said nozzles include a plurality of first nozzles through which ink droplets of a predetermined volume are ejected and a plurality of second nozzles through which ink droplets of a predetermined volume less than that of ink droplets ejected through said first nozzles are ejected, the number of said plurality of second nozzles is larger than the number of said plurality of first nozzles, at least one of said second nozzles has a center thereof located on a first imaginary line extending in the scanning direction through a center of one of said first nozzles, said second nozzles located within a predetermined distance from the first imaginary line constitute one group, and at least one of said second nozzles constituting the group has a center thereof deviating from the first imaginary line and also from a second imaginary line extending in a direction in which a plurality of groups are arranged, through a center of one of said second nozzles arranged on the first imaginary line.

2. An ink-jet printing head as claimed in claim 1, comprising:

a plurality of first ink channels that are in communication with said plurality of first nozzles;

a plurality of second ink channels that are in communication with said plurality of second nozzles;

a plurality of first ejection energy generating means provided in said first ink channels, respectively, to generate ejection energy for ejecting ink droplets through said first nozzles; and a plurality of second ejection energy generating means provided in each of said second ink channels to generate ejection energy for ejecting ink droplets through said second nozzles.

3. An ink-jet printing head as claimed in claim 2, wherein said second nozzles located on the first imaginary line are in communication with one of said second ink channels.

4. An ink-jet printing head as claimed in claim 2, wherein said second nozzles constituting the group are in communication with one of said second ink channels.

5. An ink-jet printing head as claimed in claim 2, wherein said plurality of first ejection energy generating means comprise electrothermal converters that apply thermal energy to ink in said first ink channels, respectively, and said plurality of second ejection energy generating means comprise electrothermal converters that apply thermal energy to ink in said second ink channels.

6. An ink-jet printing method for printing on a printing medium using an ink-jet printing head having a plurality of nozzles through which the printing head ejects ink droplets of the same color while moving in a scanning direction, wherein the nozzles include a plurality of first nozzles through which ink droplets of a predetermined volume are ejected and a plurality of second nozzles through which ink droplets of a predetermined volume less than that of ink droplets ejected through the first nozzles are ejected, the number of the plurality of second nozzles is larger than the number of the plurality of first nozzles, at least one of the second nozzles has a center thereof located on a first imaginary line extending in the scanning direction through a center of one of the first nozzles, the second nozzles located within a predetermined distance from the first imaginary line constitute one group, and the second nozzles constituting the group are arranged so that small dots formed on the printing medium using respective ink droplets ejected through the second nozzles constituting the group partially overlap each other, said method comprising the steps of:

ejecting ink droplets through the first and second nozzles so as to form dots of different sizes on the printing medium;

performing printing so that small dots formed on the printing medium by respective ink droplets ejected through the second nozzles constituting the group partially overlap each other;

forming a large dot using an ink droplet ejected through one of the first nozzles;

forming a middle-sized dot using a plurality of ink droplets ejected from a plurality of the second nozzles; and forming a small dot using an ink droplet ejected through one of the second nozzles.

7. An ink-jet printing method for printing on a printing medium using an ink-jet printing head having a plurality of nozzles through which the printing head ejects ink droplets of the same color while moving in a scanning direction, wherein the nozzles include a plurality of first nozzles through which ink droplets of a predetermined volume are ejected and a plurality of second nozzles through which ink droplets of a predetermined volume less than that of ink droplets ejected through the first nozzles are ejected, the number of the plurality of second nozzles is larger than the number of the plurality of first nozzles, at least one of the second nozzles has a center thereof located on a first imaginary line extending in the scanning direction through a center of one of the first nozzles, the second nozzles located within a predetermined distance from the first imaginary line constitute one group, and the second nozzles constituting the group are arranged so that small dots formed on the printing medium using respective ink droplets ejected through the second nozzles constituting the group partially overlap each other, said method comprising the steps of:

ejecting ink droplets through the first and second nozzles so as to form dots of different sizes on the printing medium;

performing printing so that small dots formed on the printing medium by respective ink droplets ejected through the second nozzles constituting the group partially overlap each other; and performing printing using a middle-sized dot formed using an ink droplet ejected through one of the first nozzles and a middle-sized dot formed using a plurality of ink droplets ejected through the second nozzles constituting the group.

8. An ink-jet printing head having a plurality of nozzles for ejecting ink droplets of the same color, comprising:

a first nozzle line on which a plurality of first nozzles for ejecting ink droplets of a predetermined volume are arranged at even intervals;

a second nozzle line on which a plurality of second nozzles for ejecting ink droplets of a volume less than that of ink droplets ejected from said first nozzles are arranged at even intervals; and a third nozzle line which is different from said second nozzle line, and on which another plurality of second nozzles for ejecting ink droplets of a volume less than that of ink droplets ejected from said first nozzles are arranged at even intervals, wherein said first and second nozzles arranged on said first, second and third nozzle lines are arranged at the same even intervals, said first nozzles arranged on said first nozzle line and said second nozzles arranged on said second nozzle line have centers thereof located on a plurality of imaginary lines which are parallel with each other, and said second nozzles arranged on said third nozzle line have centers distanced from said imaginary lines.

9. An ink-jet printing head as claimed in claim 8, wherein the centers of said second nozzles arranged on said third nozzle line are positioned at the same distance from adjacent ones of said imaginary lines.

* * * * *

UNITED STATES PATENT AND TRADEMARK OFFICE

CERTIFICATE OF CORRECTION

PATENT NO. : 6,896,357 B2
DATED : May 24, 2005
INVENTOR(S) : Shuichi Murakami et al.

It is certified that error appears in the above-identified patent and that said Letters Patent is hereby corrected as shown below:

Title page,
Item [56], References Cited, OTHER PUBLICATIONS,
"Patent Abstracts of Japan" reference, "(JP 59 187861," should read -- (JP59-187861, --.

Column 1,
Line 29, "are" should read -- are in --.
Line 43, "are appeared" should read -- appear --.

Column 2,
Line 5, "are appeared" should read -- appear --.
Line 6, "sown" should read -- shown --.
Line 11, "is appeared" should read -- appears --.

Column 3,
Line 62, "s" should read -- a --.

Column 7,
Line 36, "is not appeared" should read -- does not appear --, and "images," should read -- images, and --.

UNITED STATES PATENT AND TRADEMARK OFFICE

CERTIFICATE OF CORRECTION

PATENT NO. : 6,896,357 B2
DATED : May 24, 2005
INVENTOR(S) : Shuichi Murakami et al.

It is certified that error appears in the above-identified patent and that said Letters Patent is hereby corrected as shown below:

Column 8,
Line 47, “pass” should read -- passes --.
Line 54, “structured, the” should read -- structured, and --.
Line 67, “limited” should read -- limited to --.

Column 13,
Line 40, “alternate” should read -- alternates --.

Signed and Sealed this

Fourteenth Day of February, 2006

JON W. DUDAS
*Director of the United States Patent and Trademark Office*